US010310434B1

(12) United States Patent
Mukobayashi

(10) Patent No.: US 10,310,434 B1
(45) Date of Patent: Jun. 4, 2019

(54) IMAGE FORMING APPARATUS

(71) Applicant: Konica Minolta Inc., Tokyo (JP)

(72) Inventor: Yu Mukobayashi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/171,949

(22) Filed: Oct. 26, 2018

(30) Foreign Application Priority Data

Dec. 1, 2017 (JP) ..... 2017-231740

(51) Int. Cl.
*G03G 15/00* (2006.01)

(52) U.S. Cl.
CPC ..... *G03G 15/553* (2013.01)

(58) Field of Classification Search
CPC .. G03G 15/55; G03G 15/553; G03G 15/0863; G03G 21/1663; G03G 21/1889
USPC ..... 399/9, 24–26, 42, 109, 110, 116
See application file for complete search history.

(56) References Cited

U.S. PATENT DOCUMENTS 7,027,745 B2 * 4/2006 Yoshida ..... G03G 15/553 399/24
8,831,444 B2 * 9/2014 Shimura ..... G03G 15/011 399/26
9,223,277 B2 * 12/2015 Nakamoto ..... G03G 15/553
9,335,697 B2 * 5/2016 Yoshida ..... G03G 15/55
10,120,333 B2 * 11/2018 Shinagawa ..... G03G 15/553

FOREIGN PATENT DOCUMENTS

JP 2002207402 A 7/2002
JP 2013050601 A 3/2013

* cited by examiner

*Primary Examiner* — Hoan H Tran
(74) *Attorney, Agent, or Firm* — Lucas & Mercanti, LLP

(57) ABSTRACT

An image forming apparatus includes: photoconductors rotatable and having toner images to be formed on surfaces; a transfer belt on which the toner images formed on the photoconductors are sequentially transferred; and a hardware processor that estimates timing of arrival of end of life of one photoconductor of the photoconductors due to depletion of the surface of the one photoconductor, wherein the hardware processor calculates a depletion amount of the one photoconductor due to a toner, as a first depletion amount, based on a first parameter having a positive correlation with an amount of the toner used for the toner image formed on the surface of another photoconductor that transfers the toner image on the transfer belt before the one photoconductor, and compares the calculated first depletion amount with a predetermined life estimation threshold value to estimate the timing of arrival of end of life of the one photoconductor.

13 Claims, 18 Drawing Sheets

FIG. 4A

D1

| PHOTOCONDUCTOR TYPE (151) | ROTATION NUMBER (153) | PRINTING RATE (%) (155) | PRINTING DATE AND TIME (157) |
|---|---|---|---|
| 10Y | 10 | 5 | 2017/11/15 11:00 |
| 10M | 5 | 10 | 2017/11/15 10:58 |
| 10C | 8 | 20 | 2017/11/15 10:57 |
| 10K | 12 | 10 | 2017/11/15 10:57 |
| : | : | : | : |
| 10K | 30 | 1 | 2017/3/10 19:00 |
| 10M | 10 | 20 | 2017/3/10 18:57 |
| 10Y | 20 | 5 | 2017/3/10 18:55 |
| : | : | : | : |
| 10K | 10 | 20 | 2016/12/15 15:00 |

FIG. 4B

D1'

| PHOTOCONDUCTOR TYPE (151) | PRINTING RATE (%) (155) | ROTATION NUMBER (153) |
|---|---|---|
| 10Y | 1 | 10000 |
| | 5 | 5000 |
| | 10 | 8000 |
| | 20 | 2000 |
| 10M | 1 | 8000 |
| | 5 | 6000 |
| | 10 | 7000 |
| | 20 | 1200 |
| 10C | 1 | 11000 |
| | 5 | 8000 |
| | 10 | 9000 |
| | 20 | 1800 |
| 10K | 1 | 80000 |
| | 5 | 50000 |
| | 10 | 70000 |
| | 20 | 10000 |

FIG. 5

D2

| 160 PRINTING RATE (%) | 161 SELF DEPLETION AMOUNT (nm/rot) | 165 REVERSE TRANSFER DEPLETION AMOUNT (nm/rot) 163 167 169 | | |
|---|---|---|---|---|
| | | FIRST DEPLETION AMOUNT | SECOND DEPLETION AMOUNT | THIRD DEPLETION AMOUNT |
| 1 | 0.0184 | 0.0002 | 0.00025 | 0.00028 |
| 5 | 0.0189 | 0.00031 | 0.00038 | 0.00044 |
| 10 | 0.0193 | 0.0004 | 0.00049 | 0.00057 |
| 20 | 0.0200 | 0.0005 | 0.00062 | 0.00071 |

FIG. 6

| DEPLETION AMOUNT CALCULATION OBJECT | SELF DEPLETION AMOUNT | REVERSE TRANSFER DEPLETION AMOUNT | | |
|---|---|---|---|---|
| | | FIRST DEPLETION AMOUNT | SECOND DEPLETION AMOUNT | THIRD DEPLETION AMOUNT |
| 10Y | ○ | × | × | × |
| 10M | ○ | ○(10Y) | × | × |
| 10C | ○ | ○(10M) | ○(10Y) | × |
| 10K | ○ | ○(10C) | ○(10M) | ○(10Y) |

FIG. 10

| | DEPLETION AMOUNT DUE TO TRANSFER RESIDUAL TONER (μm) | INTEGRATED VALUE OF DEPLETION AMOUNT DUE TO REVERSE TRANSFER TONER (μm) | DEPLETION AMOUNT DUE TO REVERSE TRANSFER TONER FROM 10Y (μm) | DEPLETION AMOUNT DUE TO REVERSE TRANSFER TONER FROM 10M (μm) | DEPLETION AMOUNT DUE TO REVERSE TRANSFER TONER FROM 10C (μm) |
|---|---|---|---|---|---|
| 10Y | 18.87 | 0 | – | – | – |
| 10M | 18.87 | 0.31 | 0.31 | – | – |
| 10C | 18.87 | 0.69 | 0.38 | 0.31 | – |
| 10K | 18.87 | 1.13 | 0.44 | 0.38 | 0.31 |

×1.23

×1.42

D2

| 160 PRINTING RATE (%) | 161 SELF DEPLETION AMOUNT (nm/rot) | 165 REVERSE TRANSFER DEPLETION AMOUNT (nm/rot) FIRST DEPLETION AMOUNT | 163 SECOND DEPLETION AMOUNT | 167 THIRD DEPLETION AMOUNT 169 |
|---|---|---|---|---|
| 1 | 0.0184 | 0.0002 | 0.00025 | 0.00028 |
| 5 | 0.0189 | 0.00031 | 0.00038 | 0.00044 |
| 10 | 0.0193 | 0.0004 | 0.00049 | 0.00057 |
| 20 | 0.0200 | 0.0005 | 0.00062 | 0.00071 |

MEASURED VALUE

CALCULATED VALUE

×1.23

×1.42

| | | SELF DEPLETION AMOUNT CORRECTION COEFFICIENT |
|---|---|---|
| DEVELOPER OPERATION AMOUNT | EARLY STAGE | 1 |
| | MIDDLE STAGE | 0.995 |
| | END STAGE | 0.990 |

| | | SELF DEPLETION AMOUNT CORRECTION COEFFICIENT |
|---|---|---|
| TRANSFER BELT OPERATION AMOUNT | EARLY STAGE | 1 |
| | MIDDLE STAGE | 1.002 |
| | END STAGE | 1.004 |

| | | REVERSE TRANSFER DEPLETION AMOUNT CORRECTION COEFFICIENT |
|---|---|---|
| DEVELOPER OPERATION AMOUNT | EARLY STAGE | 1 |
| | MIDDLE STAGE | 1.2 |
| | END STAGE | 1.4 |

| | | REVERSE TRANSFER DEPLETION AMOUNT CORRECTION COEFFICIENT |
|---|---|---|
| TRANSFER BELT OPERATION AMOUNT | EARLY STAGE | 1 |
| | MIDDLE STAGE | 0.95 |
| | END STAGE | 0.90 |

151 153 154 155 157 D1

| PHOTOCONDUCTOR TYPE | ROTATION NUMBER | SECTION | PRINTING RATE (%) | PRINTING DATE AND TIME |
|---|---|---|---|---|
| 10Y | 10 | FIRST | 5 | 2017/11/15 11:00 |
| 10Y | 10 | SECOND | 10 | 2017/11/15 11:00 |
| 10Y | 10 | THIRD | 20 | 2017/11/15 11:00 |
| 10M | 5 | FIRST | 10 | 2017/11/15 10:58 |
| 10M | 5 | SECOND | 5 | 2017/11/15 10:58 |
| 10M | 5 | THIRD | 1 | 2017/11/15 10:58 |
| : | : | : | : | : |
| 10K | 10 | FIRST | 10 | 2016/12/15 15:00 |
| 10K | 10 | SECOND | 10 | 2016/12/15 15:00 |
| 10K | 10 | THIRD | 20 | 2016/12/15 15:00 |

IMAGE FORMING APPARATUS

The entire disclosure of Japanese patent Application No. 2017-231740, filed on Dec. 1, 2017, is incorporated herein by reference in its entirety.

BACKGROUND

Technological Field

The present disclosure relates to an image forming apparatus, and more particularly to life determination of an image forming apparatus.

Description of the Related Art

Image forming apparatuses such as multi functional peripherals (MFPs) have become widespread. An image forming apparatus in an electrophotographic system includes, as a printing process, a step of charging a surface of a photoconductor, a step of exposing the surface of the photo according to an input image pattern, a step of attaching a toner to an electrostatic image formed on the surface of the photoconductor by the exposure, and a step of transferring the toner attached on the surface of the photoconductor to a transfer belt.

When the steps of forming a toner image on the surface of the photoconductor and transferring the formed toner image are repeated in this way, the surface of the photoconductor is depleted. Therefore, to perform maintenance such as replacement of the photoconductor before the end of life of the photoconductor arrives, estimation of the arrival of the end of life is widely performed on the basis of a depletion amount of the photoconductor.

As an example of a technology relating to the life estimation of a photoconductor, JP 2013-50601 A discloses an image forming apparatus that "changes the life of a photosensitive drum according to an average printing rate" (see [Means for Solving Problem] in [Detailed Description of Invention]).

Further, JP 2002-207402 A discloses an image forming apparatus that "eliminates error in life estimation of a photosensitive drum due to a difference in a printing rate and increases the life detection accuracy of the photosensitive drum (see [Problem to be Solved] in [Abstract]).

However, with the above-described conventional technologies, phenomena that the accuracy of estimating the life of the photoconductor is not sufficient have occurred. Therefore, there is a need for a technology for improving the accuracy of lifetime estimation of the photoconductor.

SUMMARY

The present disclosure has been made to solve the above problem, and an object of a certain aspect is to improve the accuracy of the life estimation of the photoconductor.

To achieve the abovementioned object, according to an aspect of the present invention, an image forming apparatus reflecting one aspect of the present invention comprises: a plurality of photoconductors that is rotatable and has toner images to be formed on respective surfaces; a transfer belt on which the toner images respectively formed on the plurality of photoconductors are sequentially transferred; and a hardware processor that estimates timing of arrival of end of life of one photoconductor of the plurality of photoconductors due to depletion of the surface of the one photoconductor, wherein the hardware processor calculates a depletion amount of the one photoconductor due to a toner, as a first depletion amount, on the basis of a first parameter having a positive correlation with an amount of the toner used for the toner image formed on the surface of another photoconductor that transfers the toner image on the transfer belt before the one photoconductor, and compares the calculated first depletion amount with a predetermined life estimation threshold value to estimate the timing of arrival of end of life of the one photoconductor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 4A and 4B are diagrams illustrating an example of a rotation number history table;

FIG. 5 is a diagram illustrating an example of a depletion amount regulation table;

FIG. 6 is a diagram illustrating a relationship between photoconductors and depletion amounts to be calculated;

FIG. 10 is a diagram illustrating a breakdown of depletion of the photoconductors;

DETAILED DESCRIPTION OF EMBODIMENTS

Figure 1:
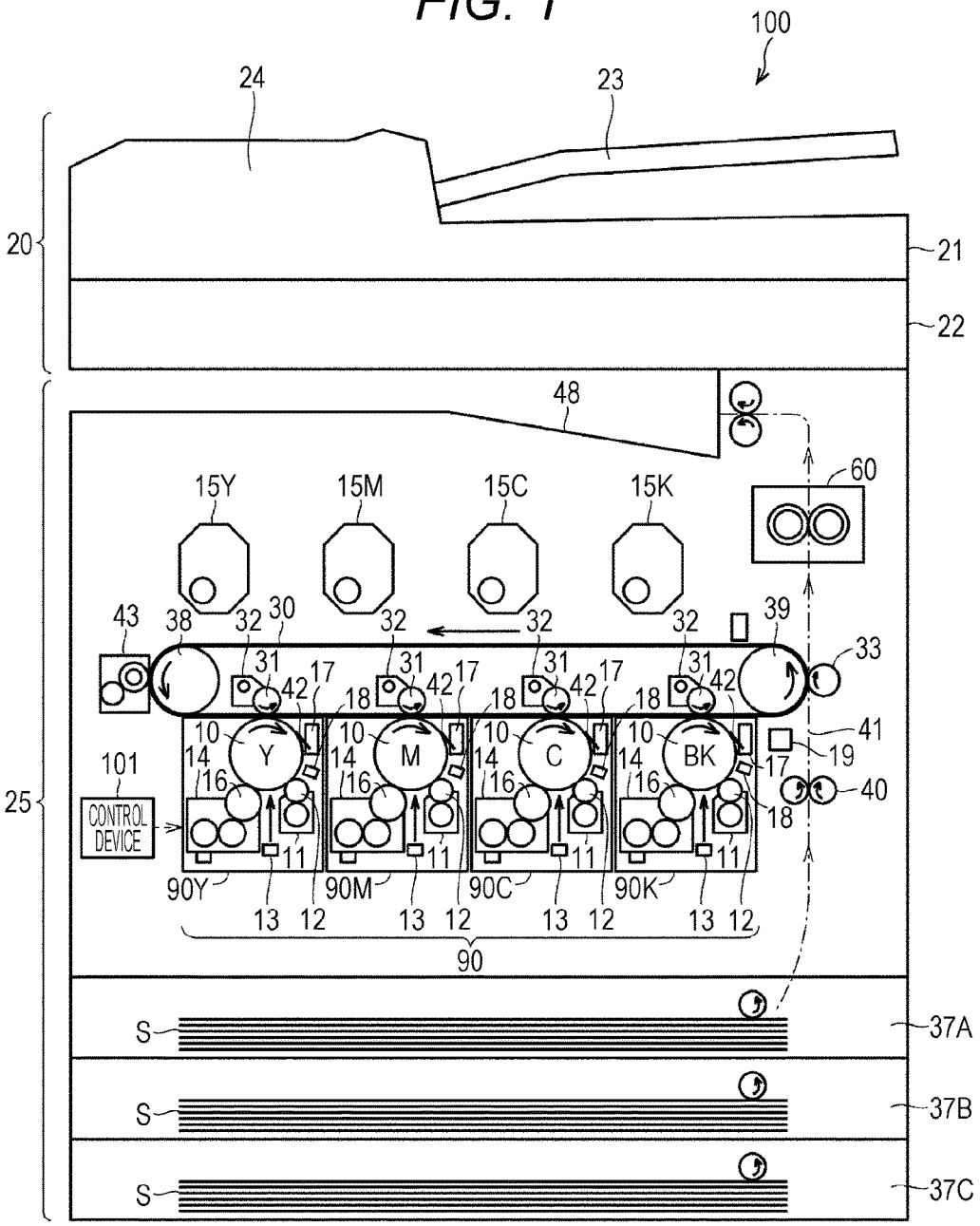
FIG. 1 is a diagram illustrating an example of an overall structure of an image forming apparatus.

Hereinafter, one or more embodiments of the present invention will be described with reference to the drawings. However, the scope of the invention is not limited to the disclosed embodiments. In the following description, the same parts and constituent elements are denoted by the same reference numerals. Names and functions of the same parts and constituent elements are also the same. Therefore, detailed description of the same parts and constituent elements is not repeated. Note that the embodiments and modifications described below may be selectively combined as appropriate.

First Embodiment

[1. Configuration of Image Forming Apparatus 100]

An image forming apparatus 100 according to an embodiment will be described with reference to FIG. 1. FIG. 1 is a diagram illustrating an example of an overall structure of the image forming apparatus 100.

FIG. 1 illustrates the image forming apparatus 100 as a color printer. Hereinafter, the image forming apparatus 100 as a color printer will be described, but the image forming apparatus 100 is not limited to a color printer. For example, the image forming apparatus 100 may be a monochrome printer or may be a multifunction peripheral (so-called MFP) of a monochrome printer, a color printer, and a facsimile machine.

The image forming apparatus 100 includes a scanner 20 as an image reader and a printer 25 including an image former 90 (image formers 90Y, 90M, 90C, and 90K in detail). The scanner 20 includes a cover 21, a sheet base 22, a sheet tray 37 (sheet trays 37A, 37B, and 37C in details), and an auto document feeder (ADF) 24. One end of the cover 21 is fixed to the sheet base 22, and the cover 21 is openable/closable with the one end as a fulcrum.

A user of the image forming apparatus 100 can set a document on the sheet base 22 by opening the cover 21. When the image forming apparatus 100 receives a scan instruction in the state where the document is set on the sheet base 22, the image forming apparatus 100 starts scan of the document set on the sheet base 22. Further, when the image forming apparatus 100 receives a scan instruction in a state where a document is set on the sheet tray 37, the image forming apparatus 100 automatically reads the document by the ADF 24 sheet by sheet.

The printer 25 includes the image formers 90Y, 90M, 90C, and 90K, an image density control (IDC) sensor 19, a transfer belt 30, a primary transfer roller 31, a transfer driver 32, a secondary transfer roller 33, the sheet trays 37A, 37B, and 37C, a driven roller 38, a drive roller 39, a registration roller 40, a cleaning unit 43, a fixing device 60, and a control device 101.

The image formers 90Y, 90M, 90C, and 90K are arranged in order along the transfer belt 30. The image former 90Y receives a toner supply from a toner bottle 15Y to form a yellow (Y) toner image. The image former 90M receives a toner supply from a toner bottle 15M to form a magenta (M) toner image. The image former 90C receives a toner supply from a toner bottle 15C to form a cyan (C) toner image. The image former 90K receives a toner supply from a toner bottle 15K to form a black (BK) toner image.

The image formers 90Y, 90M, 90C, and 90K are arranged in order in a rotation direction of the transfer belt 30 along the transfer belt 30. Each of the image formers 90Y, 90M, 90C, and 90K includes a photoconductor 10 rotatably configured, a charging device 11, an exposure device 13, a developer 14, a cleaning unit 17 including a cleaning blade 42, and a neutralization device 18.

After the image formers 90Y, 90M, 90C, and 90K operate as described above, the yellow (Y) toner image, the magenta (M) toner image, the cyan (C) toner image, and the black (BK) toner image are sequentially superimposed and transferred from the photoconductors 10 to the transfer belt 30 by transfer of the transfer driver 32. As a result, a color toner image is formed on the transfer belt 30.

The IDC sensor 19 detects the density of a toner image 35 formed on the transfer belt 30. Typically, the IDC sensor 19 is a light intensity sensor including a reflective photosensor, and detects the intensity of reflected light from a surface of the transfer belt 30.

The transfer belt 30 is stretched around the driven roller 38 and the drive roller 39. The drive roller 39 is connected to a motor (not illustrated). The drive roller 39 is rotated as the control device 101 controls the motor. The transfer belt 30 and the driven roller 38 are rotated in conjunction with the drive roller 39. As a result, the toner image 35 on the transfer belt 30 is sent to the secondary transfer roller 33.

Different sizes or types of sheets are set to the sheet trays 37A, 37B, and 37C, respectively, for example. The sheets are conveyed sheet by sheet from one set as a feed tray from among the sheet trays 37A, 37B, and 37C to a conveyance path 41. The sheet is sent to the secondary transfer roller 33 by the registration roller 40.

The control device 101 controls a transfer voltage to be applied to the secondary transfer roller 33 in accordance with timing at which the sheet is sent out. The secondary transfer roller 33 applies a transfer voltage having an opposite polarity to a charge polarity of the toner image 35 to the sheet being conveyed. As a result, the toner image 35 is attracted from the transfer belt 30 to the secondary transfer roller 33, and the toner image 35 on the transfer belt 30 is transferred.

The conveyance timing of the sheet to the secondary transfer roller 33 is controlled by the registration roller 40 in accordance with the position of the toner image 35 on the transfer belt 30. As a result, the toner image 35 on the transfer belt 30 is transferred to an appropriate position on the sheet.

The fixing device 60 pressurizes and heats the sheet passing through the fixing device 60. As a result, the toner image is fixed on the sheet. Thereafter, the sheet is discharged to a sheet discharge tray 48.

The cleaning unit 43 collects the toner remaining on the surface of the transfer belt 30 after transfer of the toner image from the transfer belt 30 to the sheet. The collected toner is conveyed by a conveying screw (not illustrated) and stored in a waste toner container (not illustrated).

[2. Hardware Configuration]

Figure 2:
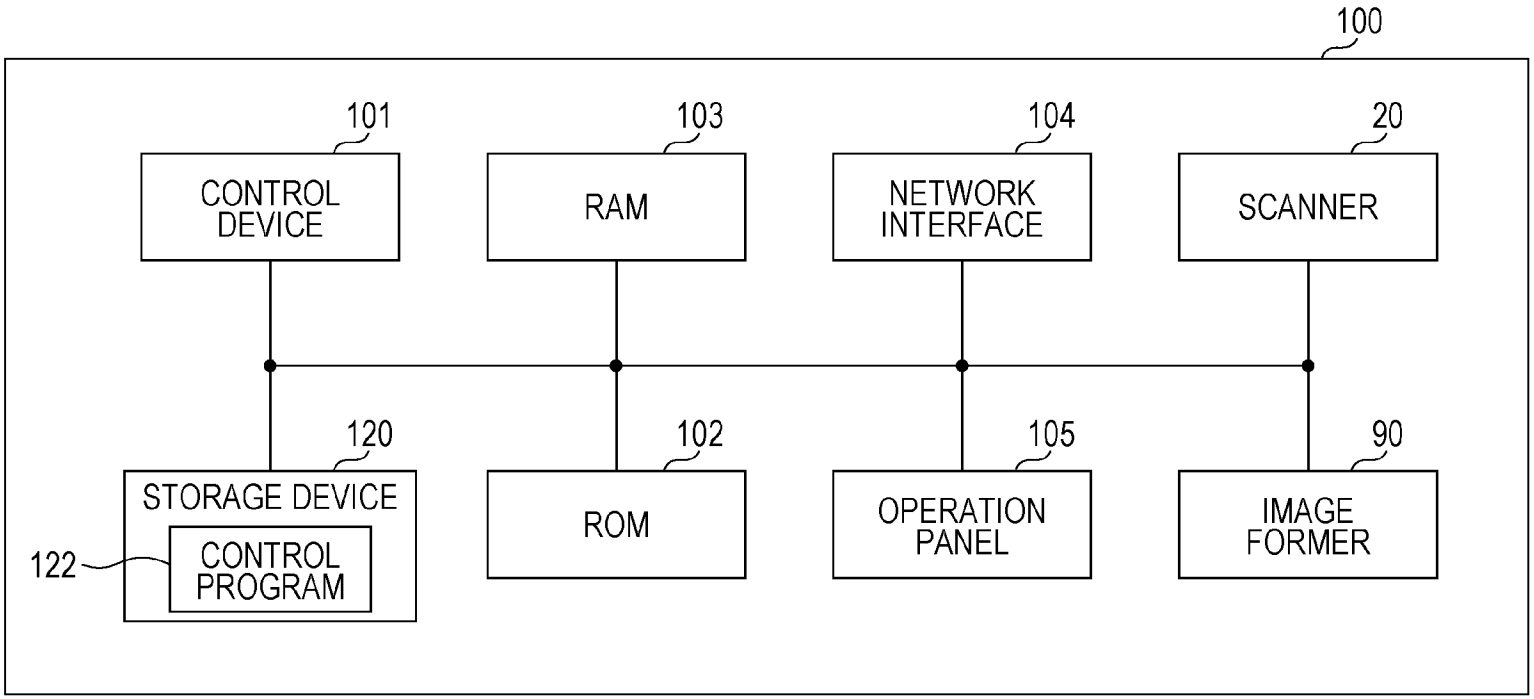
FIG. 2 is a block diagram illustrating a hardware configuration of the image forming apparatus.

An example of a hardware configuration of the image forming apparatus 100 will be described with reference to FIG. 2. FIG. 2 is a block diagram illustrating a hardware configuration of the image forming apparatus 100.

As illustrated in FIG. 2, the image forming apparatus 100 includes the control device 101, a read only memory (ROM) 102, a random access memory (RAM) 103, a network interface 104, an operation panel 105, the scanner 20, a temperature sensor 70, a humidity sensor 80, the image former 90, and a storage device 120.

The control device 101 is configured by, for example, at least one integrated circuit. The integrated circuit is configured by, for example, at least one central processing unit (CPU), at least one application specific integrated circuit (ASIC), or at least one field programmable gate array (FPGA), or a combination thereof.

The control device 101 executes various programs such as a program 122 for adjusting control parameters of the image forming apparatus 100 to control the operation of the image forming apparatus 100. The control device 101 reads the program 122 from the storage device 120 to the RAM 103 on the basis of reception of an execution instruction of the program 122. The RAM 103 functions as a working memory and temporarily stores various data necessary for execution of the program 122.

An antenna (not illustrated) and the like are connected to the network interface 104. The image forming apparatus 100 exchanges data with an external communication device via the antenna. The external communication device includes, for example, a mobile communication terminal such as a smartphone, and a server. The image forming apparatus 100 may be configured to download the program 122 from the server via the antenna.

The operation panel 105 includes a display (not illustrated) and a touch panel (not illustrated). The display and the touch panel are overlapped with each other, and the image forming apparatus 100 receives an operation on the touch panel.

The storage device 120 is, for example, a hard disk, a solid state drive (SSD), or another storage device. The storage device 120 may be either a built-in storage device or an external storage device. The storage device 120 stores the program 122 and the like according to the present embodiment. However, the storage location of the program 122 is not limited to the storage device 120, and may be stored in a storage area (for example, a cache) of the control device 101, the ROM 102, the RAM 103, an external device (for example, a server), or the like.

The program 122 may be incorporated in and provided as a part of an arbitrary program, not as a single program. In this case, control processing according to the present embodiment is realized in cooperation with the arbitrary program. Even such a program not including some of modules does not depart from the gist of the program 122 according to the present embodiment.

Furthermore, some or all of the functions provided by the program 122 may be realized by dedicated hardware. Furthermore, the image forming apparatus 100 may be configured in a form like a so-called cloud service in which at least one server executes part of the processing of the program 122.

[3. Functional Configuration]

Figure 3:
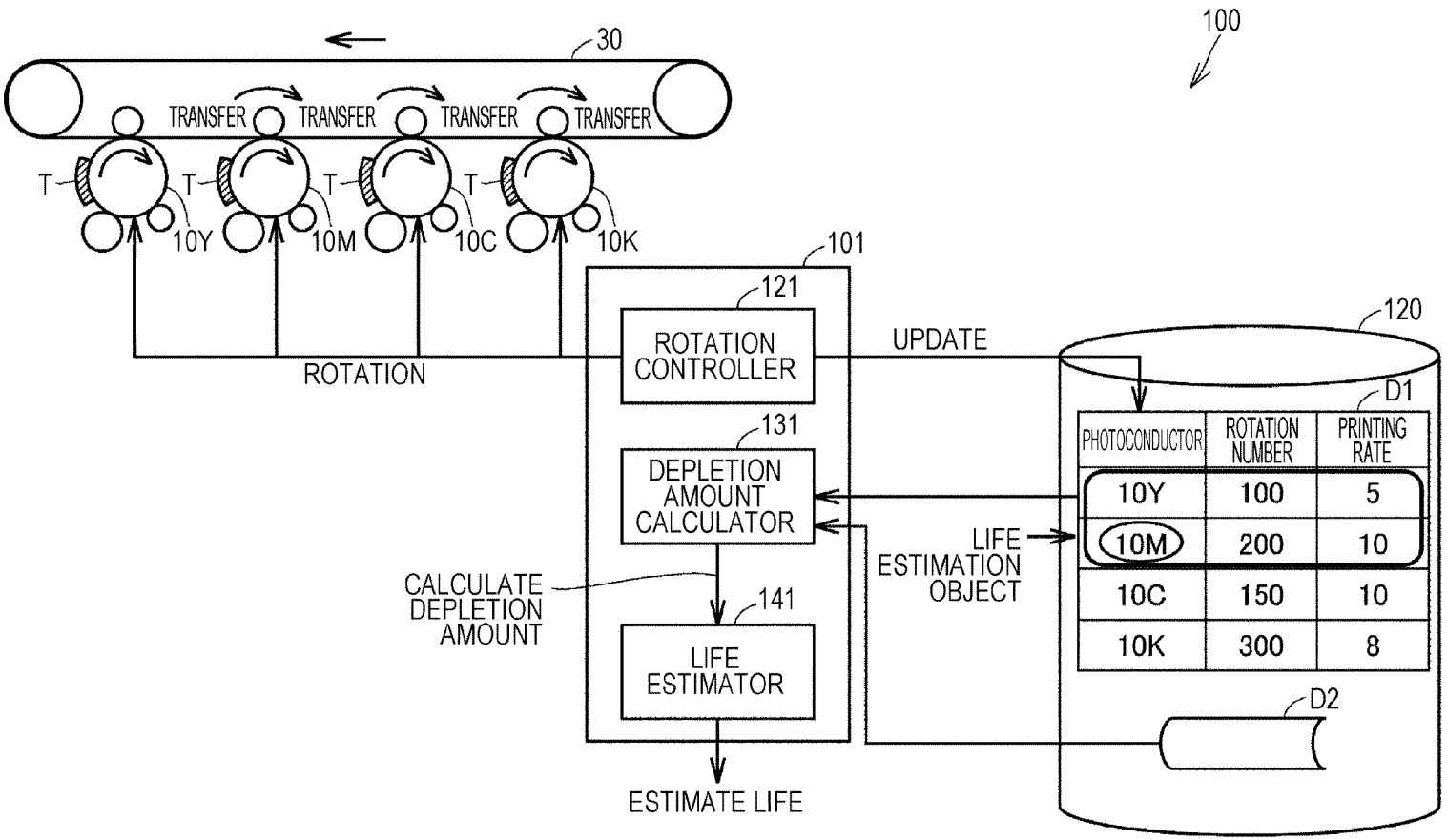
FIG. 3 is a functional block diagram of the image forming apparatus according to a first embodiment.

A functional configuration in the image forming apparatus 100 according to the first embodiment will be described with reference to FIG. 3. FIG. 3 is a functional block diagram of the image forming apparatus 100 according to the first embodiment.

As illustrated in FIG. 3, the image forming apparatus 100 includes the control device 101, the storage device 120, the photoconductors 10Y, 10M, 10C, and 10K (hereinafter simply referred to as photoconductor 10 when collectively called), and the transfer belt 30. The control device 101 includes a rotation controller 121, a depletion amount calculator 131, and a life estimator 141.

The rotation controller 121 of the control device 101 controls the rotation of the photoconductor 10 at the time of image formation. Here, the control of rotation includes control of at least either a rotational speed or a rotation number. The photoconductor 10 transfers a toner image T formed on the surface to the transfer belt 30 while being rotated by the rotation controller 121.

More specifically, the photoconductors 10Y, 10M, 10C, and 10K sequentially transfer the toner images T to the transfer belt, respectively. First, the photoconductor 10Y transfers the toner image T formed on the surface to the transfer belt 30, and then the photoconductors 10M, 10C, and 10K subsequently transfer the toner images T formed on the surfaces to the transfer belt in that order.

The rotation controller 121 further registers history information obtained by rotation of the photoconductor 10 to a rotation number history table D1 stored in the storage device 120. Details of the rotation number history table D1 will be described below.

In depletion amount calculation processing, the depletion amount calculator 131 calculates a depletion amount (corresponding to a second depletion amount) due to the toner formed on the surface of the photoconductor for which the life is estimated on the basis of an operation amount and a printing rate (corresponding to second parameters) of the photoconductor for which the life is estimated.

Further, the depletion amount calculator 131 calculates a depletion amount (corresponding to a first depletion amount) due to the toner formed on the surface of another photoconductor that transfers the toner image on the transfer belt 30 before the photoconductor for which the life is estimated on the basis of the operation amount and the printing rate (corresponding to first parameters) of the another photoconductor.

The depletion amount calculator 131 integrates the depletion amount due to the toner formed on the surface of the photoconductor and the depletion amount due to the toner formed on the surface of the another photoconductor to calculate the depletion amount of the photoconductor for which the life is estimated.

Here, as the operation amount of the photoconductor, an integrated value of rotation numbers of the photoconductor or an integrated value of rotation times of the photoconductor can be used.

To realize the above processing, the depletion amount calculator 131 acquires history information of the rotation numbers of the photoconductor for which the life is estimated (corresponding to one photoconductor) and the photoconductor (corresponding to another photoconductor) that transfers the toner image T on the transfer belt 30 before the one photoconductor by reference to the rotation number history table D1 stored in the storage device 120. The depletion amount calculator 131 further calculates the depletion amount of the photoconductor for which life estimation processing is performed with reference to a depletion amount regulation table D2 stored in the storage device 120.

The life estimator 141 of the control device 101 compares the depletion amount of the photoconductor for which the life is estimated, which has been calculated by the depletion amount calculator 131, with a predetermined life threshold value to estimate arrival of the end of life of the photoconductor for which the life is estimated. Details of the life estimation processing will be described below.

[4. Calculation of Depletion Amount]

The rotation number history table D1 will be described with reference to FIGS. 4A and 4B. FIGS. 4A and 4B are diagrams illustrating an example of the rotation number history table D1.

As illustrated in FIG. 4A, the rotation number history table D1 stores the history information of the rotation number of the photoconductor 10 for each image formation performed by the image forming apparatus 100. More specifically, the rotation number history table D1 includes, as examples, a photoconductor type 151, a rotation number 153, a printing rate 155, and a printing date and time 157.

The photoconductor type 151 is information for specifying the photoconductor on which the toner image is formed in image formation. The rotation number 153 is a rotation number of the photoconductor in each image formation. The printing rate 155 is a printing rate in each image formation. The printing rate means a rate of an image area to a printing area of a sheet. The printing rate is measured on the basis of an integrated value of the number of dots of the toner at the time of forming the toner image on the surface of the photoconductor. The printing date and time 157 indicates date and time when image formation was performed.

When the depletion amount calculator 131 acquires the rotation number history table D1, the depletion amount calculator 131 creates a rotation number aggregation table D1' in which the rotation number 153 is aggregated for each photoconductor type 151 and each printing rate 155, as illustrated in FIG. 4B. The depletion amount calculator 131 calculates the depletion amount of the photoconductor for which the life is estimated, using the rotation number aggregation table D1'. Details of the depletion amount calculation by the depletion amount calculator 131 will be described below.

The depletion amount regulation table D2 will be described with reference to FIG. 5. FIG. 5 is a diagram illustrating an example of the depletion amount regulation table D2.

The depletion amount regulation table D2 regulates the depletion amount per one rotation of the photoconductor of each printing rate. As illustrated in FIG. 5, the depletion amount regulation table D2 includes, as an example, a printing rate 160, a self depletion amount 161, and a reverse transfer depletion amount 163. The reverse transfer depletion amount 163 further includes a first depletion amount 165, a second depletion amount 167, and a third depletion amount 169.

The self depletion amount (corresponding to the second depletion amount) referred to here means the depletion amount of the surface of the photoconductor due to the toner formed on the surface of the photoconductor itself when the photoconductor is rotated once. For example, as illustrated in FIG. 5, in a case where the printing rate is 5%, the photoconductor is depleted by 0.0189 nm per one rotation.

In contrast, the reverse transfer depletion amount (corresponding to the first depletion amount) means the depletion amount of the surface of the photoconductor for which the life is estimated, which is caused by the toner transferred on the photoconductor (hereinafter, the transfer is also referred to as "reverse transfer"), the toner being formed when the photoconductor (hereinafter, also referred to as "upstream" photoconductor) that transfers the toner image on the transfer belt before the photoconductor for which the life is estimated is rotated once.

The first depletion amount 165 indicates the amount of depletion of the surface of the photoconductor for which the life is estimated, which is caused by the toner reversely transferred on the photoconductor, the toner being formed when the photoconductor (hereinafter, referred to as one-upstream photoconductor) that transfers the toner image on the transfer belt one-photoconductor before the photoconductor for which the life is estimated is rotated once.

The second depletion amount 167 indicates the amount of depletion of the surface of the photoconductor for which the life is estimated, which is caused by the toner reversely transferred on the photoconductor, the toner being formed when the photoconductor (hereinafter, referred to as two-upstream photoconductor) that transfers the toner image on the transfer belt two-photoconductors before the photoconductor for which the life is estimated is rotated once.

The third depletion amount 169 indicates an amount of depletion of the surface of the photoconductor for which the life is estimated, which is caused by the toner reversely transferred on the photoconductor, the toner being formed when the photoconductor (hereinafter, referred to as three-upstream photoconductor) that transfers the toner image on the transfer belt three-photoconductors before the photoconductor for which the life is estimated is rotated once.

The depletion amount calculator 131 calculates the depletion amount of the photoconductor for which the life is estimated, as described below on the basis of the rotation number aggregation table D1' and the depletion amount regulation table D2.

A method of calculating the depletion amount of the photoconductor for which the life is estimated will be described with reference to FIG. 6. FIG. 6 is a diagram illustrating a relationship between the photoconductors 10Y to 10K and depletion amounts to be calculated.

As illustrated in FIG. 6, methods of calculating the depletion amounts of the photoconductors 10Y, 10M, 10C, and 10K are different. In a case of calculating the depletion amount of the photoconductor 10Y, the depletion amount calculator 131 calculates only the self depletion amount by the photoconductor 10Y. This is because there is no photoconductor that transfers the toner image on the transfer belt 30 before the photoconductor 10Y, and thus there is no need to consider the depletion amount due to reverse transfer.

In contrast, in a case of calculating the depletion amount of the photoconductor 10M, the depletion amount calculator 131 calculates an integrated value of the self depletion amount and the reverse transfer depletion amount. In this case, as the reverse transfer depletion amount, the first depletion amount caused by a one-upstream photoconductor (corresponding to the photoconductor 10Y) is calculated. This is because the photoconductor that transfers the toner image on the transfer belt 30 before the photoconductor 10M is only the photoconductor 10Y.

Further, in a case of calculating the depletion amount of the photoconductor 10C, the depletion amount calculator 131 calculates an integrated value of the self depletion amount and the reverse transfer depletion amount. In this case, as the reverse transfer depletion amount, an integrated value of the first depletion amount caused by the one-upstream photoconductor (corresponding to the photoconductor 10M) and the second depletion amount caused by a two-upstream photoconductor (corresponding to the photoconductor 10Y) is calculated. This is because the photoconductors that transfer the toner image to the transfer belt 30 before the photoconductor 10C are the photoconductors 10Y and 10M.

Further, in a case of calculating the depletion amount of the photoconductor 10K, the depletion amount calculator 131 calculates an integrated value of the self depletion amount and the reverse transfer depletion amount. In this case, as the reverse transfer depletion amount, an integrated value of the first depletion amount caused by the one-upstream photoconductor (corresponding to the photoconductor 10C), the second depletion amount caused by the two-upstream photoconductor (corresponding to the photoconductor 10K), and the third depletion amount caused by a three-upstream photoconductor (corresponding to the photoconductor 10Y) is calculated. This is because the photoconductors that transfer the toner image on the transfer belt 30 before the photoconductor 10K are the photoconductors 10Y, 10M, and 10C.

Hereinafter, the depletion amounts of the photoconductors 10Y to 10K will be specifically obtained for the rotation number aggregation table D1' illustrated in FIG. 4B and the depletion amount regulation table D2 illustrated in FIG. 5. The depletion amount calculator 131 calculates the product of the rotation number and the depletion amount for each printing rate in the rotation number aggregation table D1' and the depletion amount regulation table D2, and calculates the sum of the products (hereinafter also referred to as integrated depletion amount).

The integrated depletion amount of the photoconductor 10Y is obtained by the following equation using the relationship illustrated in FIG. 6.

The integrated depletion amount(photoconductor 10*Y*)=the self depletion amount(photoconductor 10*Y*)

The depletion amount calculator 131 calculates the sum of products of the rotation number and the depletion amount as the self depletion amount, for each printing rate of the depletion amount regulation table D2 on the basis of the rotation number 153 of the photoconductor 10Y in the rotation number aggregation table D1'.

The self depletion amount (photoconductor 10Y)=0.0184 (nm)×10000+0.0189 (nm)×5000+0.0193 (nm)×8000+0.0200 (nm)×2000=472.9 (nm)=0.4729 (μm)

Therefore, the integrated depletion amount (photoconductor 10Y)=0.4729 (μm).

The integrated depletion amount of the photoconductor 10M is obtained by the following equation using the relationship illustrated in FIG. 6.

The integrated depletion amount(photoconductor 10*M*)=the self depletion amount(photoconductor 10*M*)+the reverse transfer depletion amount(first depletion amount(photoconductor 10*Y*))

The depletion amount calculator 131 calculates the sum of products of the rotation number and the depletion amount as the self depletion amount, for each printing rate of the depletion amount regulation table D2 on the basis of the rotation number 153 of the photoconductor 10M in the rotation number aggregation table D1'.

The self depletion amount (photoconductor 10M)=0.0184 (nm)×8000+0.0189 (nm)×6000+0.0193 (nm)×7000+0.0200 (nm)×1200=419.7 (nm)=0.4197 (μm)

The depletion amount calculator 131 calculates the sum of products of the rotation number and the depletion amount as the first depletion amount, for each printing rate of the depletion amount regulation table D2 on the basis of the rotation number 153 of the photoconductor 10Y in the rotation number aggregation table D1'.

The reverse transfer depletion amount (first depletion amount photoconductor 10Y))=0.0002 (nm)×10000+0.00031 (nm)×5000+0.0004 (nm)×8000+0.0005 (nm)×2000=7.75 (nm)=0.00775 (μm)

Therefore, the integrated depletion amount (photoconductor 10M)=0.4197 (μm)+0.00775 (μm)=0.42745 (μm).

The integrated depletion amount of the photoconductor 10C is obtained by the following equation using the relationship illustrated in FIG. 6. The integrated depletion amount (photoconductor 10C)=the self depletion amount (photoconductor 10C)+the reverse transfer depletion amount (the first depletion amount (photoconductor 10M)+the second depletion amount (photoconductor 10Y))

The depletion amount calculator 131 calculates the sum of products of the rotation number and the depletion amount as the self depletion amount, for each printing rate of the depletion amount regulation table D2 on the basis of the rotation number 153 of the photoconductor 10C in the rotation number aggregation table D1'.

The self depletion amount (photoconductor 10C)=0.0184 (nm)×11000+0.0189 (nm)×8000+0.0193 (nm)×9000+0.0200 (nm)×1800=563.3 (nm)=0.5633 (μm)

The depletion amount calculator 131 calculates the sum of products of the rotation number and the depletion amount as the first depletion amount, for each printing rate of the depletion amount regulation table D2 on the basis of the rotation number 153 of the photoconductor 10M in the rotation number aggregation table D1'.

The reverse transfer depletion amount (first depletion amount (photoconductor 10M))=0.0002 (nm)×8000+0.00031 (nm)×6000+0.0004 (nm)×7000+0.0005 (nm)×1200=6.86 (nm)=0.00686 (μm)

The depletion amount calculator 131 calculates the sum of products of the rotation number and the depletion amount as the second depletion amount, for each printing rate of the depletion amount regulation table D2 on the basis of the rotation number 153 of the photoconductor 10Y in the rotation number aggregation table D1'.

The reverse transfer depletion amount (second depletion amount (photoconductor 10Y))=0.00025 (nm)×10000+0.00038 (nm)×5000+0.00049 (nm)×8000+0.00062 (nm)×2000=9.56 (nm)=0.00956 (μm)

Therefore, the integrated depletion amount (photoconductor 10C)=0.5633 (μm)+0.00686 (μm)+0.00956 (μm)=0.57972 (μm).

The integrated depletion amount of the photoconductor 10K is obtained by the following equation using the relationship illustrated in FIG. 6.

The integrated depletion amount(photoconductor 10*K*)=the self depletion amount(photoconductor 10*K*)+the reverse transfer depletion amount(the first depletion amount(photoconductor 10*C*)+the second depletion amount(photoconductor 10*M*)+the third depletion amount(photoconductor 10*Y*))

The depletion amount calculator 131 calculates the sum of products of the rotation number and the depletion amount as the self depletion amount, for each printing rate of the depletion amount regulation table D2 on the basis of the rotation number 153 of the photoconductor 10K in the rotation number aggregation table D1'.

The self depletion amount (photoconductor 10K)=0.0184 (nm)×80000+0.0189 (nm)×50000+0.0193 (nm)×70000+0.0200 (nm)×10000=3968 (nm)=3.968 (μm)

The depletion amount calculator 131 calculates the sum of products of the rotation number and the depletion amount as the first depletion amount, for each printing rate of the depletion amount regulation table D2 on the basis of the rotation number 153 of the photoconductor 10C in the rotation number aggregation table D1'.

The reverse transfer depletion amount (first depletion amount (photoconductor 10C))=0.0002 (nm)×11000+

0.00031 (nm)×8000+0.0004 (nm)×9000+0.0005 (nm)×1800=9.18 (nm)=0.00918 (μm)

The depletion amount calculator 131 calculates the sum of products of the rotation number and the depletion amount as the second depletion amount, for each printing rate of the depletion amount regulation table D2 on the basis of the rotation number 153 of the photoconductor 10M in the rotation number aggregation table D1'.

The reverse transfer depletion amount (second depletion amount (photoconductor 10M))=0.00025 (nm)×8000+0.00038 (nm)×6000+0.00049 (nm)×7000+0.00062 (nm)×1200=8.454 (nm)=0.008454 (μm)

The depletion amount calculator 131 calculates the sum of products of the rotation number and the depletion amount as the third depletion amount, for each printing rate of the depletion amount regulation table D2 on the basis of the rotation number 153 of the photoconductor 10Y in the rotation number aggregation table D1'.

The reverse transfer depletion amount (third depletion amount (photoconductor 10Y))=0.00028 (nm)×10000+0.00044 (nm)×5000+0.00057 (nm)×8000+0.00071 (nm)×2000=10.98 (nm)=0.01098 (μm)

Therefore, the integrated depletion amount (photoconductor 10C)=3.968 (μm)+0.00918 (μm)+0.008454 (μm)+0.01098 (μm)=3.996614 (μm).

As described above, the depletion amount calculator 131 of the control device 101 integrates the self depletion amount with the rotation of the photoconductor to be calculated and the reverse transfer depletion amount due to the toner formed on the upstream photoconductors to calculate the depletion amount in calculating the depletion amount of the photoconductor.

[5. Estimation of Life]

Figure 7:
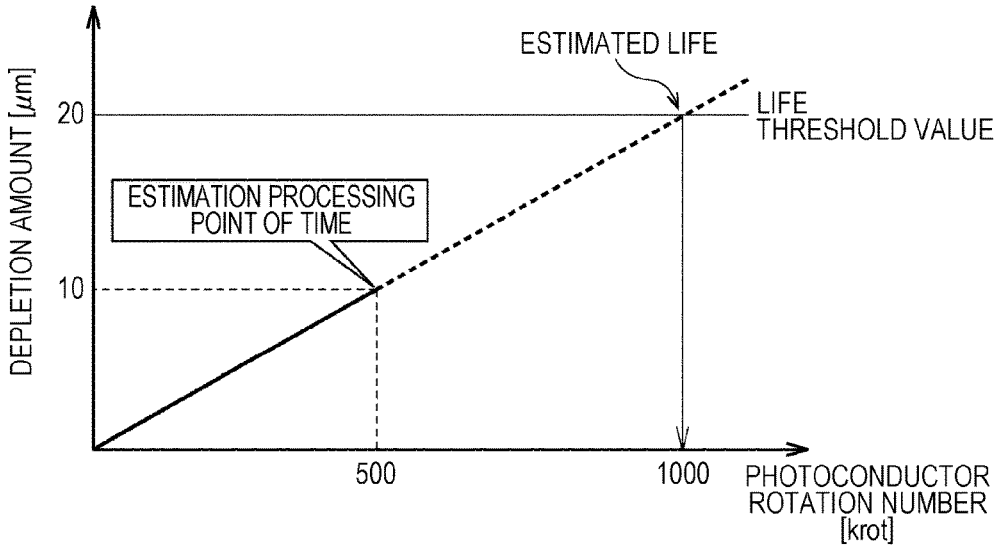
FIG. 7 is a graph illustrating a life estimation method.

Life estimation of the photoconductor by the life estimator 141 will be described with reference to FIG. 7. FIG. 7 is a graph illustrating a life estimation method.

For simplicity of description, FIG. 7 illustrates an example in which the depletion amount of the photoconductor calculated by the depletion amount calculator 131 is 10 (μm) and a life threshold value is 20 (μm). Then, assuming that the integrated value of the rotation numbers of the photoconductor at the estimation processing of this time is 500 (krot). Note that, here, (krot) represents 1000 rotations.

The life estimator 141 compares the depletion amount (10 μm) with the life threshold value (20 μm), and determines that the photoconductor has not yet reached the end of life. Further, the life estimator 141 estimates the rotation number of the photoconductor, which is predicted at the timing when the end of life arrives, on the basis of the ratio between the depletion amount and the life threshold value. In the example illustrated in FIG. 7, since the life threshold value is 20 (μm) with respect to the depletion amount 10 (μm) of the photoconductor, the photoconductor is depleted to half of the life threshold value. Therefore, the life estimator 141 estimates the integrated value of the rotation numbers of the photoconductor at the timing when the end of life arrives as 1000 (krot) on the basis of the fact that the integrated value of the rotation numbers of the photoconductor is 500 (krot). That is, in the present embodiment, the life estimator 141 estimates the life estimation timing of the photoconductor with the integrated value of the rotation numbers of the photoconductor. Note that the life estimation timing may be estimated with another physical amount such as a rotation time of the photoconductor or the number of printed sheets in the image forming apparatus.

[6. Method of Creating Depletion Amount Regulation Table D2]

Figure 8:
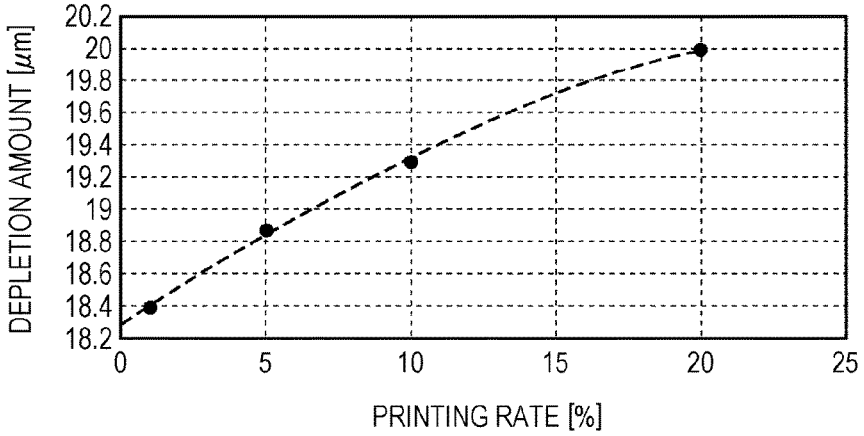
FIG. 8 is a diagram illustrating a relationship between a printing rate and a measured value of the depletion amount of a photoconductor.
Figure 9:
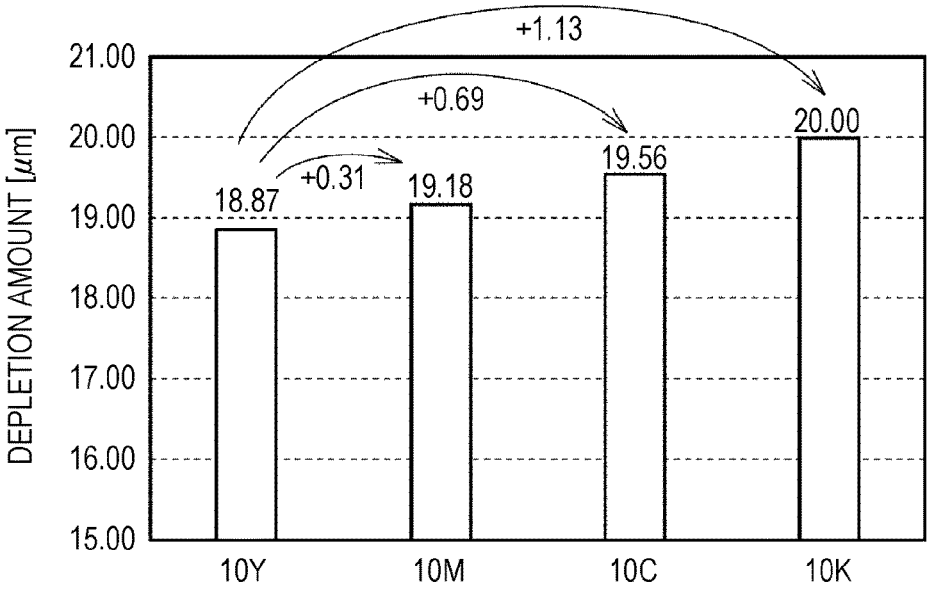
FIG. 9 is a histogram illustrating the depletion amounts when photoconductors are rotated to a predetermined rotation number.
Figures 11, 12:
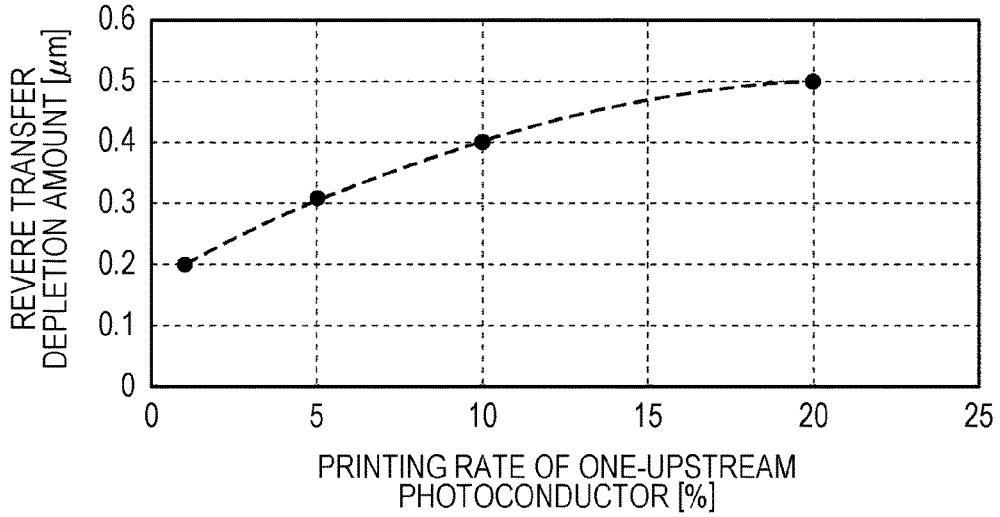
FIG. 11 is a diagram illustrating a relationship between the printing rate of a one-upstream photoconductor and the depletion amount.
FIG. 12 is a diagram illustrating a depletion amount regulation table.

Hereinafter, a method of creating the depletion amount regulation table D2 will be described with reference to FIGS. 8 to 12. FIG. 8 is a diagram illustrating a relationship between the printing rate of the photoconductor 10Y and a measured value of the depletion amount. FIG. 9 is a histogram illustrating the depletion amounts when the photoconductors 10Y, 10M, 10C, and 10K are rotated to a predetermined rotation number. FIG. 10 is a diagram illustrating a breakdown of depletion of the photoconductors. FIG. 11 is a diagram illustrating a relationship between the printing rate of a one-upstream photoconductor and the depletion amount. FIG. 12 is a diagram illustrating the depletion amount regulation table D2.

As illustrated in FIG. 8, the depletion amount of the photoconductor becomes larger as the printing rate becomes higher. This is because as the toner remaining on the photoconductor (hereinafter referred to as transfer residual toner) at the time of transfer to the transfer belt becomes larger as the printing rate is higher, and the toner accumulated on the cleaning blade 42 scrapes the surface of the photoconductor.

FIG. 9 illustrates the measured values of the depletion amounts when the photoconductors 10Y, 10M, 10C, and 10K are rotated by 1000 (krot). At this time, a charge amount and an adhesion amount of the toner formed on the surface of each photoconductor are substantially the same. The printing rate is 5% in each photoconductor. Here, as illustrated in FIG. 9, the depletion amount of a more upstream photoconductor is smaller. The difference in the depletion amount is considered due to the reverse transfer toner caused by the toner transferred from the upstream photoconductor to the transfer belt 30.

That is, since there is no upstream photoconductor for the photoconductor 10Y, no depletion due to the reverse transfer toner occurs. Therefore, the depletion amount (18.87 (μm)) on the photoconductor 10Y is considered to be caused by the transfer residual toner by the rotation of the photoconductor 10Y itself.

When comparing the depletion amounts between the photoconductor 10Y and 10M, the difference is 19.18-18.87=0.31 (μm). The difference between the depletion amounts is considered to be caused by the reverse transfer toner from the photoconductor 10Y that is one-upstream of the photoconductor 10M.

When comparing the depletion amounts between the photoconductors 10Y and 10C, the difference is 19.56-18.87=0.69 (μm). The difference between the depletion amounts is considered to be caused by the reverse transfer toners from the photoconductor 10M that is one-upstream of the photoconductor 10C and the photoconductor 10Y that is two-upstream of the photoconductor 10C.

When comparing the depletion amounts between the photoconductors 10Y and 10K, the difference is 20.00-18.87=1.13 (μm). This 1.13 (μm) is considered to be caused by the reverse transfer toners from the photoconductor 10C that is one-upstream of the photoconductor 10K, the photoconductor 10M that is two-upstream of the photoconductor 10K, and the photoconductor 10Y that is three-upstream of the photoconductor 10K.

A breakdown of the depletion amounts due to the reverse transfer toners from the upstream photoconductors will be described with reference to FIG. 10. As illustrated in FIG. 10, in the photoconductors 10Y to 10K, the depletion amounts due to the transfer residual toners themselves (that is, the self depletion amounts) are uniformly 18.87 (μm).

Then, the depletion amount due to the reverse transfer toner (that is, the reverse transfer depletion amount) on the photoconductor 10M is 0.31 (μm).

As described above, the depletion amount due to the reverse transfer toner on the photoconductor 10M is considered to be caused by the reverse transfer toner from the photoconductor 10Y. Therefore, the depletion amount due to the reverse transfer toner from the one-upstream photoconductor is 0.31 (μm).

The depletion amount due to the reverse transfer toner on the photoconductor 10C is 0.69 (μm). As described above, the depletion amount due to the reverse transfer toner on the photoconductor 10C is caused by the reverse transfer toner from the photoconductor 10Y and the reverse transfer toner from the photoconductor 10M.

Here, considering the fact that the depletion amount due to the reverse transfer toner from the one-upstream photoconductor 10M is 0.31 (μm), the depletion amount due to the reverse transfer from the two-upstream photoconductor 10Y is 0.38 (μm).

The depletion amount due to the reverse transfer toner on the photoconductor 10K is 1.13 (μm). As described above, the depletion amount due to the reverse transfer toner on the photoconductor 10K is caused by the reverse transfer toner from the photoconductor 10*y*, the reverse transfer toner from the photoconductor 10M, and the reverse transfer toner from the photoconductor 10C.

Here, considering the fact that the depletion amount due to the reverse transfer toner from the one-upstream photoconductor 10C is 0.31 (μm) and the depletion amount due to the reverse transfer toner from the two-upstream photoconductor 10M is 0.38 (μm), the depletion amount due to the reverse transfer from the three-upstream photoconductor 10Y is 0.44 (μm).

As described above, contribution by an upper-stream photoconductor to the depletion amount due to the reverse transfer toner becomes larger. This is because the toner on the transfer belt receives a larger amount of positive changes from a transfer region and becomes more easily separated from the transfer belt as the toner passes through the transfer region on the transfer belt for a longer time. As a result, the amount to be reversely transferred of the toner on the transfer belt 30 increases, and the depletion amount of the reversely transferred photoconductor increases, accordingly.

As described above, it is found that the depletion amount due to the reverse transfer toner from an upper-stream photoconductor becomes larger in the case where a plurality of upstream photoconductors exists.

Specifically, in the example illustrated in FIG. 10, when the depletion amount due to the reverse transfer toner from a one-upstream photoconductor is 1, the ratio of the depletion amount due to the reverse transfer toner from a two-upstream photoconductor is 1.23, and the ratio of the depletion amount due to the reverse transfer toner from a three-upstream photoconductor is 1.42.

FIG. 11 illustrates a relationship between the printing rate of a one-upstream photoconductor and the measured value of the reverse transfer depletion amount. As illustrated in FIG. 11, it is found that the reverse transfer depletion amount increases as the printing rate of the one-upstream photoconductor increases. From the above, the printing rate of the upstream photoconductor needs to be considered in calculating the depletion amount of the photoconductor for which the depletion amount is calculated.

As illustrated in FIG. 12, the second depletion amount is defined as 1.23 times the first depletion amount. Further, the third depletion amount is defined as 1.42 times the first depletion amount. By doing so, the depletion amount calculator 131 can calculate the depletion amount such that the reverse transfer depletion amount from an upper-stream photoconductor becomes larger in the case where a plurality of photoconductors exists for the photoconductor for which the life is estimated. Note that, in creating the depletion amount regulation table D2, the self depletion amount and the first depletion amount are obtained in measured values, and the second depletion amount and the third depletion amount are calculated on the basis of the measured values.

[7. Processing Procedure]

Figure 13:
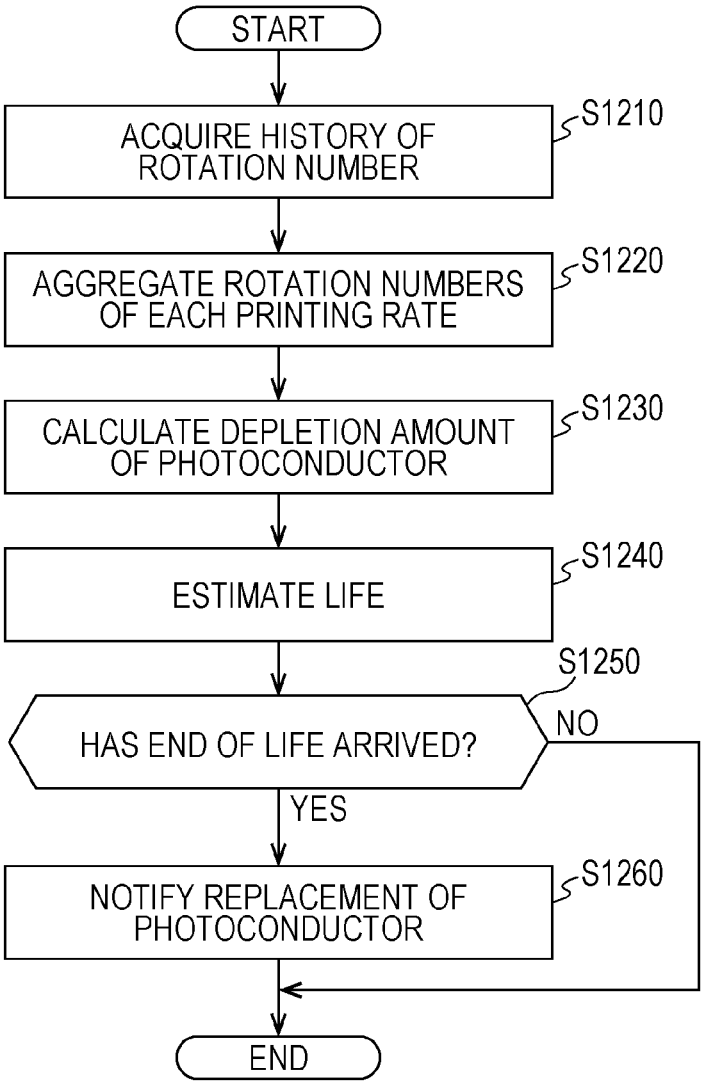
FIG. 13 is a flowchart illustrating a procedure of life estimation processing.

A procedure of the life estimation processing according to the first embodiment will be described with reference to FIG. 13. FIG. 13 is a flowchart illustrating a procedure of the life estimation processing. This processing is realized when the CPU functioning as the control device 101 executes a given program, for example.

In step S1210, the depletion amount calculator 131 of the control device 101 acquires the history information of the rotation number of the photoconductor 10 from the rotation number history table D1.

In step S1220, the depletion amount calculator 131 aggregates the rotation numbers of each printing rate in the rotation number history table D1 to create the rotation number aggregation table D1'.

In step S1230, the depletion amount calculator 131 calculates the depletion amount for the photoconductor for which the life is estimated.

In step S1240, the life estimator 141 performs the life estimation by comparing the calculated depletion amount with the predetermined life threshold value.

In step S1250, the life estimator 141 determines whether the end of life has arrived. In a case where the life estimator 141 determines that the end of life has arrived (YES in step S1250) as a result of the life estimation, the control device 101 advances the processing to step S1260. Otherwise (NO in step S1250), the control device 101 terminates the processing.

In step S1260, the control device 101 displays, on the operation panel 105, replacement of the photoconductor determined to have reached the end of life to notify the user. The control device 101 terminates the processing.

[6. Conclusion]

As described above, the control device 101 according to the present embodiment calculates the depletion amount due to the reverse transfer toner on the basis of parameters having a positive correlation with the amount of the toner used for the toner image formed on the upstream photoconductor of the photoconductor for which the life is estimated. Further, the control device 101 calculates the depletion amount due to the transfer residual toner on the basis of parameters having a correlation with the amount of the toner used for the toner image formed on the photoconductor itself for which the life is estimated.

The control device 101 calculates the integrated value of the depletion amount due to the transfer residual toner and the depletion amount due to the reverse transfer toner, and compares the calculated integrated value with the predetermined life estimation threshold value to estimate the timing when the end of life of the one photoconductor arrives.

With the above configuration, not only the depletion amount due to the toner formed by the photoconductor for which the life is estimated but also the depletion amount due to the toner formed by the upstream photoconductors are taken into consideration in estimating the life of the photoconductor. Therefore, the life estimation of the photoconductor can be performed with higher accuracy.

Second Embodiment

[1. Overview]

Hereinafter, a second embodiment will be described. The second embodiment is different from the first embodiment in that a calculation result of a depletion amount is stored in a storage device as a history and life estimation is performed on the basis of the history. Note that, in the present embodiment, similar configurations to the configurations of the image forming apparatus 100 according to the above-described embodiment are denoted by the same reference numerals as those of the image forming apparatus 100. Therefore, description of the similar configurations is not repeated.

[2. Details]

Figure 14:
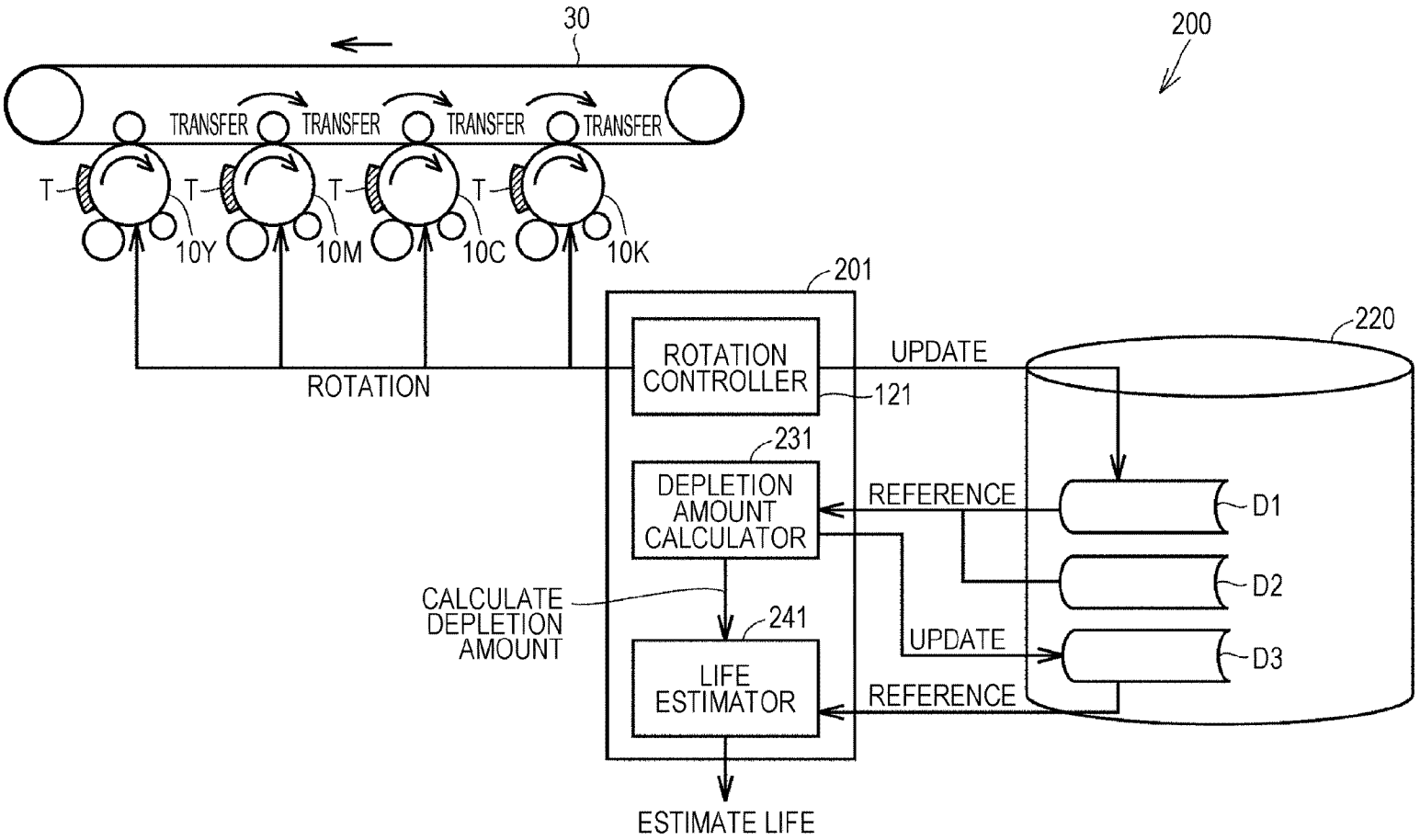
FIG. 14 is a functional block diagram of an image forming apparatus according to a second embodiment.
Figure 15:
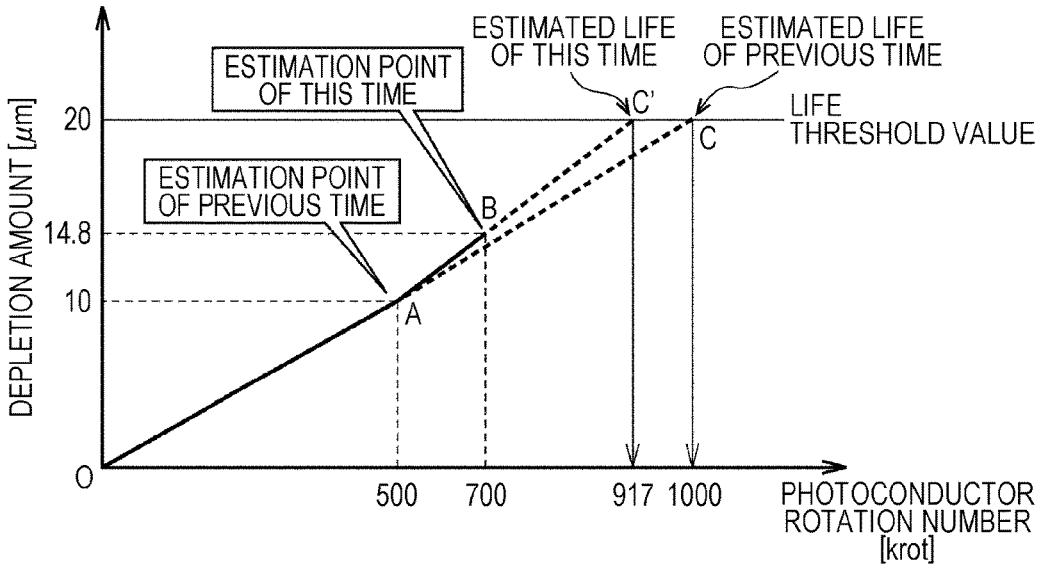
FIG. 15 is a graph illustrating a life estimation method in the second embodiment.

An image forming apparatus 200 according to the second embodiment will be described will be described with reference to FIGS. 14 and 15. FIG. 14 is a functional block diagram of the image forming apparatus 200 according to the second embodiment. FIG. 15 is a graph illustrating a life estimation method in the second embodiment.

As illustrated in FIG. 14, the image forming apparatus 200 includes a control device 201 and a storage device 220 in place of the control device 101 and the storage device 120 with respect to the configuration of the image forming apparatus 100 illustrated in FIG. 3.

The control device 201 includes a rotation controller 121, a depletion amount calculator 231, and a life estimator 241. The storage device 220 includes a rotation number history table D1, a depletion amount regulation table D2, and a depletion amount history table D3. The depletion amount calculator 231 stores the calculation result of the depletion amount in the depletion amount history table D3 provided in the storage device 120, and the life estimator 241 performs life estimation by reference to the depletion amount history table D3.

The depletion amount history table D3 includes the calculation result of the depletion amount of the photoconductor at the timing of performing the life estimation processing. The life estimator 241 estimates timing when the end of life of the photoconductor for which the life is estimated has arrived on the basis of the depletion amount of the photoconductor for which the life is estimated, which has been calculated by the depletion amount calculator 231, and the depletion amount history table D3.

In the second embodiment, the life estimator 241 performs life estimation on the basis of the depletion amount calculated at the time of life estimation of previous time by reference to the depletion amount history table D3.

In the example illustrated in FIG. 15, a rate of change of the depletion amount to a rotation number of the photoconductor is a slope illustrated by the straight line OA in the life estimation result of the previous time. The timing when the end of life arrives estimated in this case is illustrated by the point C, and is timing when the rotation number of the photoconductor becomes 1000 (krot).

In contrast, the rate of change of the depletion amount to the rotation number of the photoconductor is a slope illustrated by the straight line AB in the life estimation result of this time. In this case, the life estimated of this case is illustrated by the point C', and is timing when the rotation number of the photoconductor becomes 917 (krot). As described above, the change in the depletion amount and the rotation number from the life estimation of the previous time is calculated on the basis of the calculation result of the depletion amount at the time of the life estimation of the previous time. Therefore, the life estimation can be performed with higher accuracy.

[3. Conclusion]

As described above, in the second embodiment, the life estimation is performed on the basis of the result of the estimation processing of the previous time by reference to the result of the estimation processing of the previous time.

With the above configuration, the accuracy of the life estimation can be further improved.

Third Embodiment

[1. Overview]

Hereinafter, a third embodiment will be described. The third embodiment is different from the first embodiment in that a calculated depletion amount of a photoconductor is corrected on the basis of an operation amount of a consumable member provided in an image forming apparatus. Note that, in the present embodiment, similar configurations to the configurations of the image forming apparatus 100 according to the above-described embodiment are denoted by the same reference numerals as those of the image forming apparatus 100. Therefore, description of the similar configurations is not repeated.

[2. Details]

Figure 16:
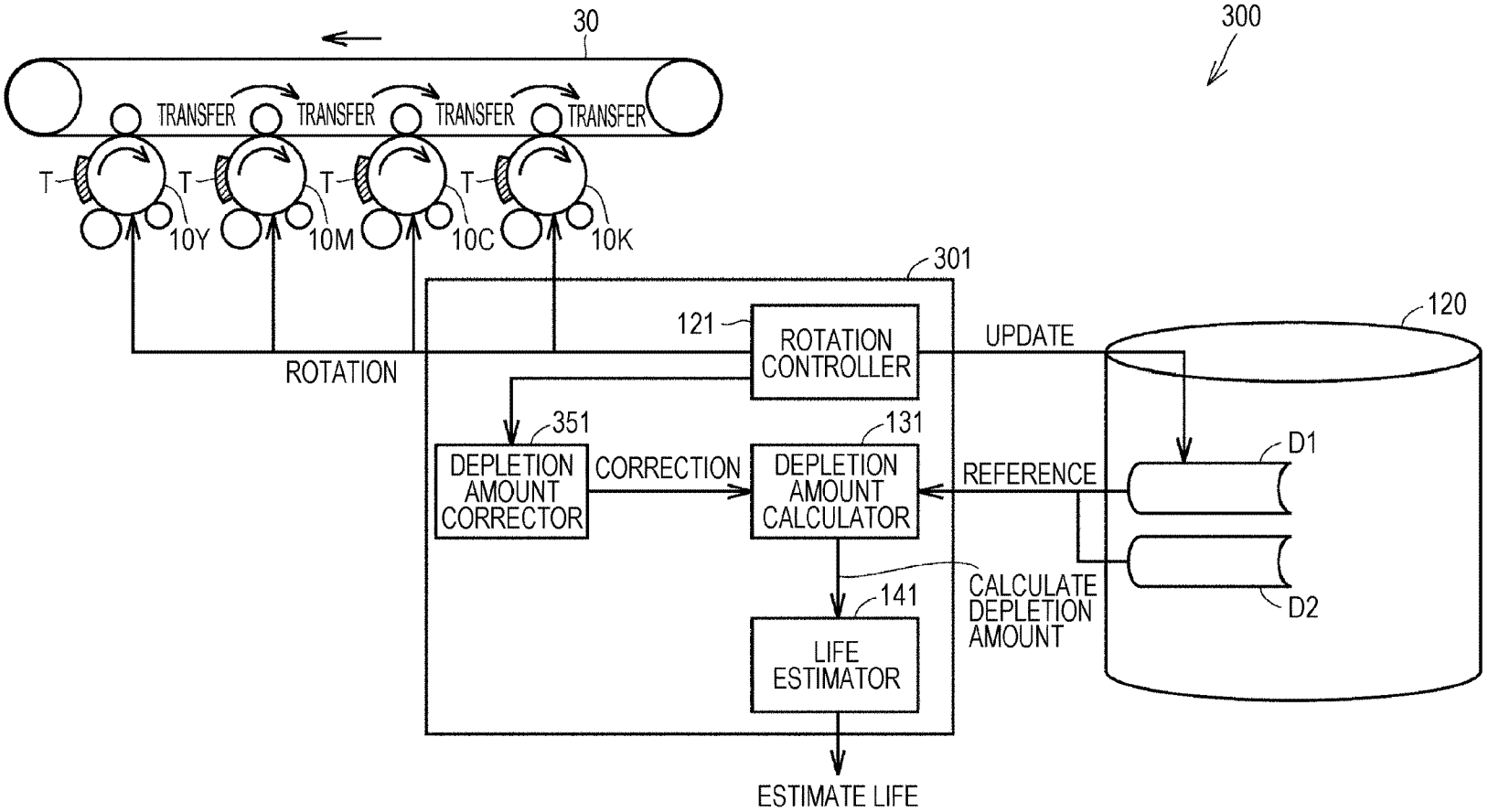
FIG. 16 is a functional block diagram of an image forming apparatus according to a third embodiment.

FIG. 16 is a functional block diagram of an image forming apparatus 300 according to the third embodiment. As illustrated in FIG. 16, the image forming apparatus 300 includes a control device 301 in place of the control device 101 with respect to the configuration of the image forming apparatus 100. In addition to the configuration illustrated in FIG. 3, the control device 301 further includes a depletion amount corrector 351. The depletion amount corrector 351 corrects the depletion amount calculated by a depletion amount calculator 131 on the basis of the operation amount of a consumable member such as a developer 14 or a transfer belt 30.

More specifically, the depletion amount corrector 351 determines the operation amounts of the developer 14 and the transfer belt 30 on the basis of control information from a rotation controller 121. The depletion amount corrector 351 corrects the depletion amount of a photoconductor for which the life is estimated, which is calculated by the depletion amount calculator 131, on the basis of the operation amounts of the developer 14 and the transfer belt 30.

Here, the operation amount of the developer can be any one of the number of printed sheets in the image forming apparatus 300, a rotation number of the developing roller provided in the developer 14, and a rotation time of the developing roller.

Further, the operation amount of the transfer belt 30 can be any one of the number of printed sheets in the image forming apparatus 300, a traveling distance of the transfer belt 30, and a traveling time of the transfer belt 30.

Figures 17, 18A, 18B:
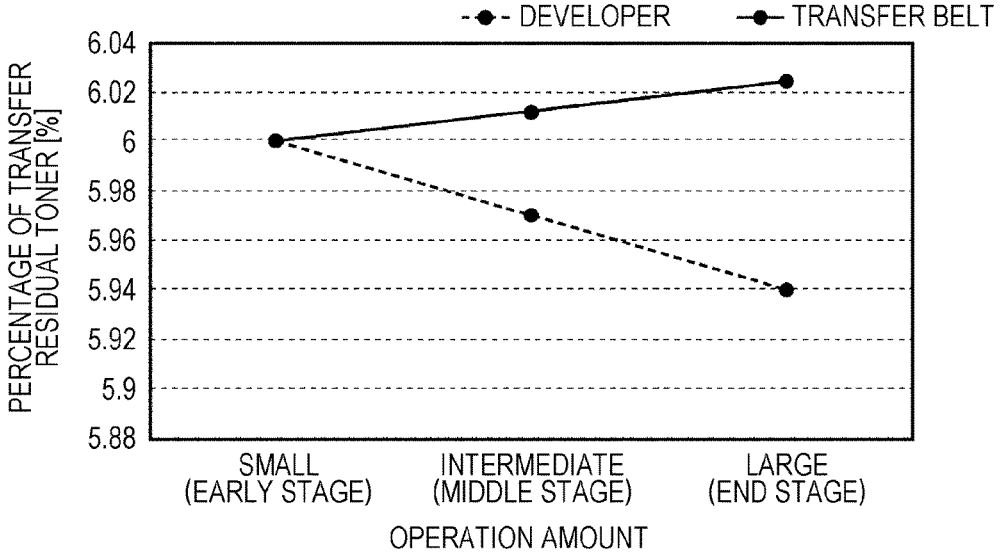
FIG. 17 is a diagram illustrating operation amounts of a developer and a transfer belt and a percentage of a transfer residual toner.
FIGS. 18A and 18B are diagrams illustrating correction coefficients of self depletion amounts with respect to operation amounts of a developer and a transfer belt.

A relationship between the operation amounts of the developer 14 and the transfer belt 30 and a percentage of a transfer residual toner is illustrated with reference to FIG. 17. FIG. 17 is a diagram illustrating the operation amounts of the developer 14 and the transfer belt 30, and the percentage of the transfer residual toner. Here, the operation amount can be counted by, for example, the number of printed sheets on which image formation is performed.

As illustrated in FIG. 17, the percentage of the transfer residual toner decreases as the operation amount of the developer 14 increases. This is because a charge amount to a toner decreases as the operation amount of the developer 14 increases, and thus a transfer rate to the transfer belt rises.

In contrast, the percentage of the transfer residual toner increases as the operation amount of the transfer belt 30 increases. This is because a belt surface becomes rough and the transfer rate decreases as the operation amount of the transfer belt 30 increases.

FIGS. 18A and 18B are diagrams illustrating correction coefficients of self depletion amounts with respect to the operation amounts of the developer 14 and the transfer belt 30. Since the amount of the transfer residual toner and the depletion amount of the photoconductor have a positive correlation, the depletion amount can be more accurately calculated by multiplying a self depletion amount 161 in a depletion amount regulation table D2 in FIG. 5 by the correction coefficients in FIGS. 18A and 18B.

Figures 19, 20A, 20B:
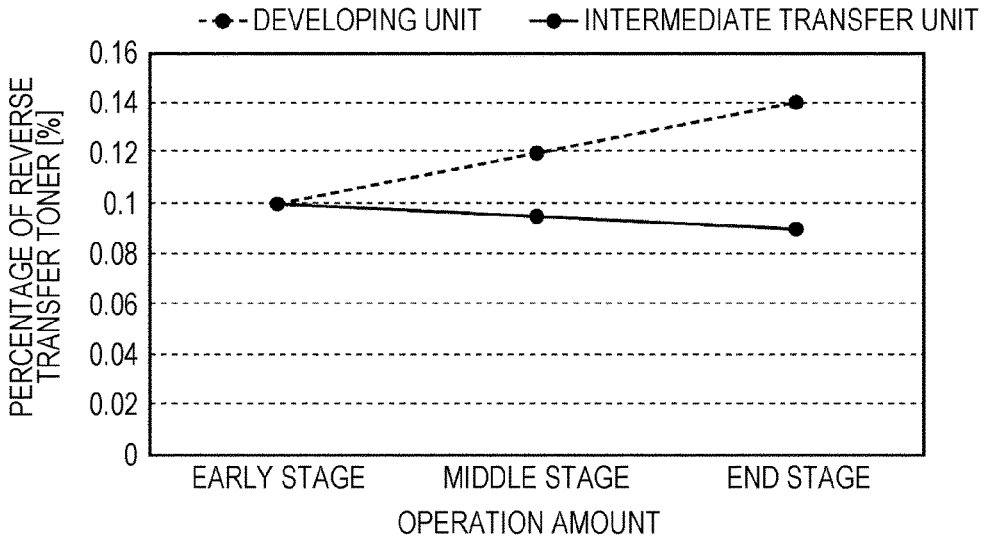
FIG. 19 is a diagram illustrating operation amounts of a developer and a transfer belt and a percentage of a reverse transfer toner.
FIGS. 20A and 20B are diagrams illustrating correction coefficients of reverse transfer depletion amounts with respect to operation amounts of a developer and a transfer belt.

A relationship between the operation amounts of the developer 14 and the transfer belt 30 and a percentage of a reverse transfer toner is illustrated with reference to FIG. 19. FIG. 19 is a diagram illustrating the operation amounts of the developer 14 and the transfer belt 30, and the percentage of the reverse transfer toner.

As illustrated in FIG. 19, the percentage of the reverse transfer toner increases as the operation amount of the developer 14 increases. This is because the charge amount to the toner decreases as the operation amount of the developer 14 increases, and thus the toner becomes easily separated from the transfer belt 30 and becomes easily reversely transferred.

In contrast, the percentage of the reverse transfer toner decreases as the operation amount of the transfer belt 30 increases. This is because as the surface of the belt becomes rough, absorption force between the belt and the toner rises, and the toner becomes less easily reversely transferred, as the operation amount of the transfer belt 30 increases.

FIGS. 20A and 20B are diagrams illustrating correction coefficients of reverse transfer depletion amounts with respect to the operation amounts of the developer 14 and the transfer belt 30. Since the amount of the transfer residual toner and the depletion amount of the photoconductor have a correlation, the depletion amount can be more accurately calculated by multiplying a reverse transfer depletion amount 163 in the depletion amount regulation table D2 in FIG. 5 by the correction coefficients in FIGS. 20A and 20B.

[3. Conclusion]

As described above, the depletion amount corrector 351 included in the control device 301 corrects the depletion amount calculated by the depletion amount calculator 131 on the basis of the operation amount of the developer 14 or the transfer belt 30.

With the above configuration, the depletion amount of the photoconductor can be accurately corrected according to the operation amount of the consumable member such as the developer 14 or the transfer belt 30, and the accuracy of the life estimation of the photoconductor can be improved.

Fourth Embodiment

[1. Overview]

Hereinafter, a fourth embodiment will be described. The fourth embodiment is different from the first embodiment in that a depletion amount is calculated for each of a plurality of sections divided in a longitudinal direction of a photoconductor. Note that, in the present embodiment, similar configurations to the configurations of the image forming apparatus 100 according to the above-described embodiment are denoted by the same reference numerals as those of the image forming apparatus 100. Therefore, description of the similar configurations is not repeated.

[2. Details]

Figure 21:
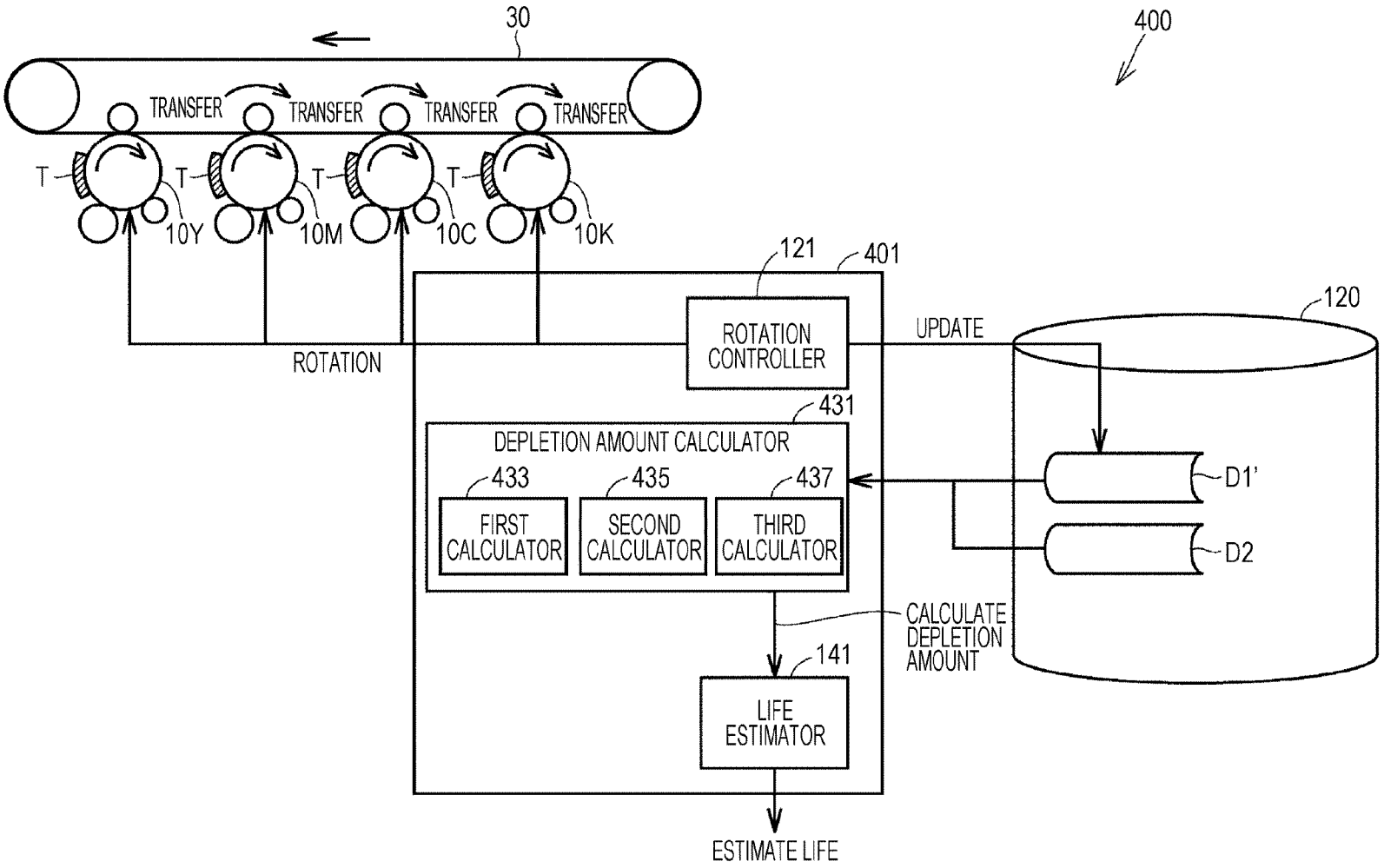
FIG. 21 is a functional block diagram of an image forming apparatus according to a fourth embodiment.

FIG. 21 is a functional block diagram of an image forming apparatus 400 according to the fourth embodiment. As illustrated in FIG. 21, the image forming apparatus 400 includes a control device 401 in place of the control device 101 with respect to the configuration of the image forming apparatus 100. The control device 401 includes a rotation controller 121, a life estimator 141, and a depletion amount calculator 431. The depletion amount calculator 431 includes a first calculator 433, a second calculator 435, and a third calculator 437 for calculating the depletion amount for three sections along the longitudinal direction of the photoconductor.

Figures 22, 23:
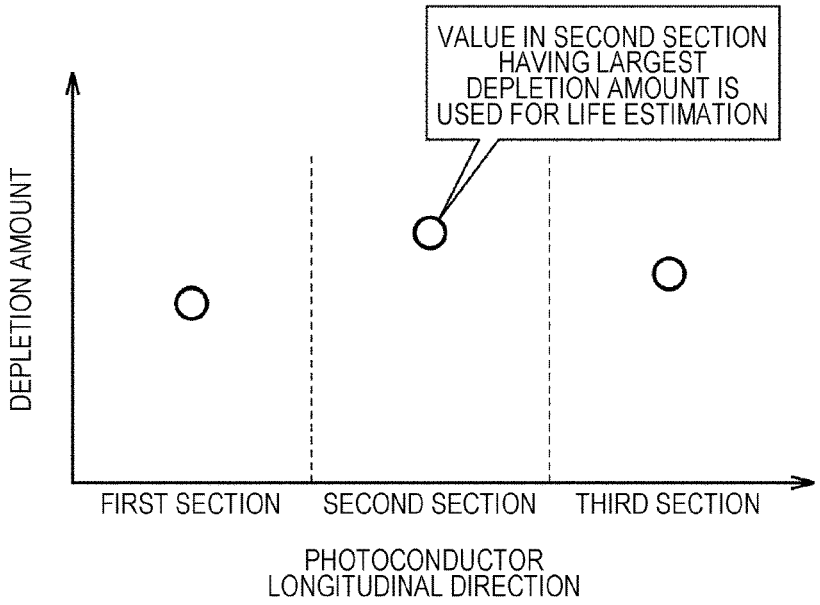
FIG. 22 is a diagram illustrating a rotation number history table according to the fourth embodiment.
FIG. 23 is a diagram exemplarily illustrating the magnitude of the depletion amount calculated for each section.

FIG. 22 is a diagram illustrating a rotation number history table D1 according to the fourth embodiment. As illustrated in FIG. 22, the rotation number history table D1 includes a section 154. The section 154 means three sections in a case where the photoconductor is divided into the three sections in the longitudinal direction. The rotation number history table D1 stores a printing rate for each of a first section, a second section, and a third section every time image formation is executed.

The first calculator 433 included in the depletion amount calculator 431 calculates the depletion amount in the first section of the photoconductor. The second calculator 435 calculates the depletion amount in the second section of the photoconductor. The third calculator 437 calculates the depletion amount in the third section of the photoconductor.

FIG. 23 is a diagram exemplarily illustrating the magnitude of the depletion amount calculated for each section. In the example illustrated in FIG. 23, the depletion amount calculated in the second section is larger than the depletion amounts calculated in the other sections. Therefore, the life estimator 141 performs life estimation of the photoconductor, using the depletion amount calculated in the second section. Since the printing rate sometimes differs in the longitudinal direction in the photoconductor, the accuracy of the life estimation is improved by performing the life estimation on the basis of the depletion amount in the section where the depletion amount is the largest.

[3. Conclusion]

As described above, the depletion amount calculator 431 calculates the depletion amount for each of the sections divided in the longitudinal direction of the photoconductor.

With the above configuration, the life estimation can be performed with more accuracy by calculating the depletion amount for each of the sections divided along the longitudinal direction even in the case where the printing rate differs along the longitudinal direction of the photoconductor.

Fifth Embodiment

[1. Overview]

Hereinafter, a fifth embodiment will be described. The present embodiment is different from the first embodiment in that a life estimation device configured as a server performs life estimation. Note that, in the present embodiment, similar configurations to the configurations of the image forming apparatus 100 according to the above-described embodiment are denoted by the same reference numerals as those of the image forming apparatus 100. Therefore, description of the similar configurations is not repeated.

[2. Details]

Figure 24:
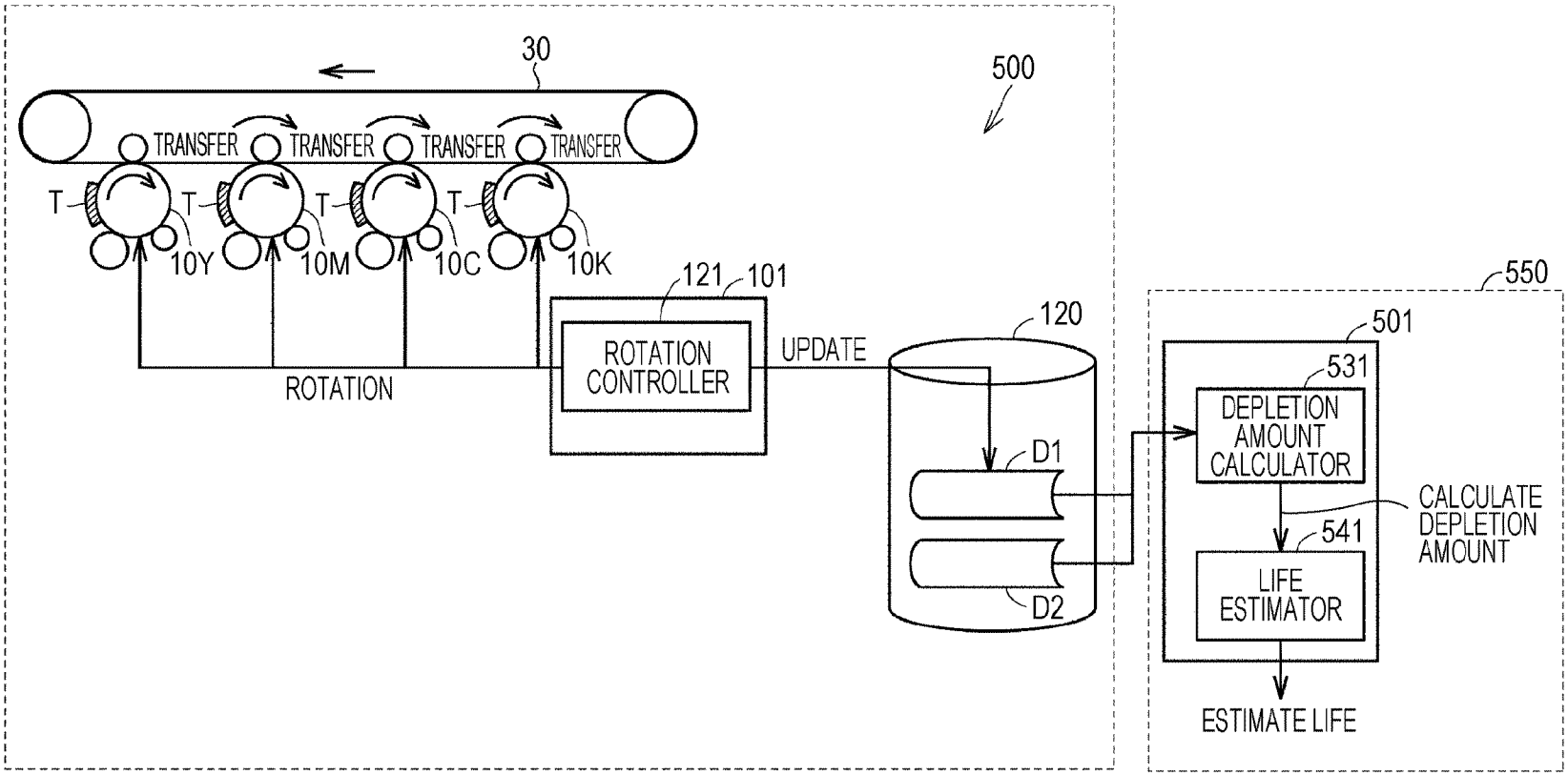
FIG. 24 is a functional block diagram of a life estimation device according to a fifth embodiment.

Functions of a life estimation device 550 according to the fifth embodiment will be described with reference to FIG. 24. FIG. 24 is a functional block diagram of the life estimation device 550 according to the fifth embodiment.

As illustrated in FIG. 24, the life estimation device 550 includes a control device 501. The control device 501 is configured by, for example, at least one integrated circuit. The integrated circuit is configured by, for example, at least one central processing unit (CPU), at least one application specific integrated circuit (ASIC), or at least one field programmable gate array (FPGA), or a combination thereof.

The life estimation device 550 functions as a so-called server and is configured to be able to communicate with an image forming apparatus 500 through a network. The image forming apparatus 500 has a similar configuration to the image forming apparatus 100 illustrated in FIG. 3. The life estimation device 550 includes a depletion amount calculator 531 and a life estimator 541. The life estimation device 550 estimates the life of the photoconductor on the basis of a rotation number history table D1 and a depletion amount regulation table D2 transmitted from the image forming apparatus 500.

The life estimation device 550 acquires information such as the temperature and humidity in the image forming apparatus 500, operation amounts of a developer 14 and a transfer belt 30, and content of printing images, and analyzes variation in the life estimation from an operation state of the image forming apparatus 500. Further, the life estimation device 550 may transmit a threshold value of an integrated value of weighting or life exponents to another image forming apparatus in a similar operation state.

Further, the life estimation device 550 may modify a threshold value of an integrated value of weighting coefficients or life exponents of a reverse transfer depletion amount according to the degree of image quality requirement by a user, or may be configured to adjust various life determination parameters with respect to a plurality of image forming apparatuses to modify the integrated value of the weighting coefficients or the life exponents according to a region, a season, a company, or a business style. With the configuration, parts can be ordered and replaced at appropriate timing by a plurality of apparatuses, the cost of replacement parts can be reduced, and labor cost reduction and inventory reduction can be realized.

[3. Conclusion]

As described above, the life estimation device 550 performs the life estimation of the photoconductor for the communicatively configured image forming apparatus 500.

With the configuration, the life estimation for a plurality of image forming apparatuses can be performed by a single life estimation device, and the operation states of the plurality of image forming apparatuses can be centrally managed, whereby the life estimation processing can be efficiently performed.

Other Embodiments

Note that the scope of application of the technical idea according to the present disclosure is not limited to the above embodiments. For example, in the above-described embodiments, the depletion amount calculator 131 calculates the depletion amount as the integrated value of the self depletion amount and the reverse transfer depletion amount for the photoconductor for which the life is estimated. However, the depletion amount calculator 131 may be configured to calculate only the reverse transfer depletion amount. In this case, as for the self depletion amount, a depletion amount statistically predicted from the integrated value of the rotation numbers of the photoconductor or the operation amount such as the rotation time of the photoconductor may be used. By doing so, the difference in the depletion amounts in the photoconductors 10Y, 10M, 10C, and 10K can be considered on the basis of the reverse transfer depletion amounts, and the life estimation with higher accuracy can be performed.

Although embodiments of the present invention have been described and illustrated in detail, the disclosed embodiments are made for purposes of illustration and example only and not limitation. The scope of the present invention should be interpreted by terms of the appended claims, and it is intended that all modifications within the meaning and scope equivalent to the claims are included.

What is claimed is:

1. An image forming apparatus comprising:

a plurality of photoconductors that is rotatable and has toner images to be formed on respective surfaces;

a transfer belt on which the toner images respectively formed on the plurality of photoconductors are sequentially transferred; and a hardware processor that estimates timing of arrival of end of life of one photoconductor of the plurality of photoconductors due to depletion of the surface of the one photoconductor, wherein the hardware processor calculates a depletion amount of the one photoconductor due to a toner, as a first depletion amount, on the basis of a first parameter having a positive correlation with an amount of the toner used for the toner image formed on the surface of another photoconductor that transfers the toner image on the transfer belt before the one photoconductor, and compares the calculated first depletion amount with a predetermined life estimation threshold value to estimate the timing of arrival of end of life of the one photoconductor.

2. The image forming apparatus according to claim 1, wherein the first parameter includes an operation amount of the another photoconductor and a printing rate of when the toner image is formed on the surface of the another photoconductor.

3. The image forming apparatus according to claim 2, wherein the operation amount includes an integrated value of rotation numbers of the photoconductor or an integrated value of rotation times of the photoconductor.

4. The image forming apparatus according to claim 2, wherein the printing rate is calculated according to a dot count of the toner of when the toner image is formed on the surface of the photoconductor.

5. The image forming apparatus according to claim 1, wherein the hardware processor further calculates the depletion amount of the one photoconductor due to a toner, as a second depletion amount, on the basis of a second parameter having a positive correlation with an amount of the toner used for the toner image formed on the surface of the one photoconductor, calculates an integrated value of the first depletion amount and the second depletion amount, and compares the calculated integrated value with a predetermined life estimation threshold value to estimate the timing of arrival of end of life of the one photoconductor.

6. The image forming apparatus according to claim 5, wherein the second parameter includes an operation amount of the one photoconductor and a printing rate of when the toner image is formed on the surface of the one photoconductor.

7. The image forming apparatus according to claim 5, wherein, in a case where there is a plurality of the other photoconductors, the hardware processor calculates the first depletion amount such that the depletion amount of the one photoconductor due to the toner used for the toner image formed on the surface of another photoconductor becomes larger, the another photoconductor transferring the toner image on the transfer belt earlier than the plurality of the other photoconductors.

8. The image forming apparatus according to claim 5, wherein the photoconductor has a cylindrical shape, and the hardware processor calculates the integrated value for each of a plurality of sections in a cylinder axis direction of the photoconductor.

9. The image forming apparatus according to claim 1, wherein the hardware processor further corrects an estimation result of the life on the basis of an operation amount of a consumable member provided in the image forming apparatus.

10. The image forming apparatus according to claim 9, wherein the consumable member is a developer that forms the toner image on the surface of the photoconductor, and the operation amount includes any one of the number of printed sheets in the image forming apparatus, a rotation number of a developing roller provided in the developer, and a rotation time of the developing roller.

11. The image forming apparatus according to claim 9, wherein the consumable member is the transfer belt, and the operation amount includes any one of the number of printed sheets in the image forming apparatus, a traveling distance of the transfer belt, and a traveling time of the transfer belt.

12. A non-transitory recording medium storing a computer readable control program for life estimation of an image forming apparatus, the image forming apparatus including a plurality of photoconductors that is rotatable and has toner images to be formed on respective surfaces, a transfer belt on which the toner images respectively formed on the plurality of photoconductors are sequentially transferred, and a hardware processor that estimates timing of arrival of end of life of one photoconductor of the plurality of photoconductors due to depletion of the surface of the one photoconductor, the control program causing the hardware processor to perform:

calculating a depletion amount of the one photoconductor due to a toner, as a first depletion amount, on the basis of a first parameter having a positive correlation with an amount of the toner used for the toner image formed on the surface of another photoconductor that transfers the toner image on the transfer belt before the one photoconductor; and comparing the calculated first depletion amount with a predetermined life estimation threshold value to estimate the timing of arrival of end of life of the one photoconductor.

13. A life estimation device for life estimation of an image forming apparatus, the image forming apparatus including a plurality of photoconductors that is rotatable and has toner images to be formed on respective surfaces, and a transfer belt on which the toner images respectively formed on the plurality of photoconductors are sequentially transferred, the life estimation device comprising:

a hardware processor that estimates timing of arrival of end of life of one photoconductor of the plurality of photoconductors due to depletion of the surface of the one photoconductor, wherein the hardware processor calculates a depletion amount of the one photoconductor due to a toner, as a first depletion amount, on the basis of a first parameter having a positive correlation with an amount of the toner used for the toner image formed on the surface of another photoconductor that transfers the toner image on the transfer belt before the one photoconductor, and compares the calculated first depletion amount with a predetermined life estimation threshold value to estimate the timing of arrival of end of life of the one photoconductor.

* * * * *